US011041669B2

(12) United States Patent
Murata et al.

(10) Patent No.: US 11,041,669 B2
(45) Date of Patent: Jun. 22, 2021

(54) DEODORIZING APPARATUS AND REFRIGERATOR INCLUDING THE SAME

(71) Applicant: Samsung Electronics Co., Ltd, Suwon-si (KR)

(72) Inventors: Kenichi Murata, Kanagawa (JP); Dae Sung Lee, Kanagawa (JP); Kazutoshi Takenoshita, Kanagawa (JP); Hiroto Ohnari, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 228 days.

(21) Appl. No.: 16/194,194

(22) Filed: Nov. 16, 2018

(65) Prior Publication Data

US 2019/0145692 A1 May 16, 2019

(30) Foreign Application Priority Data

Nov. 16, 2017 (JP) ..... JP2017-221243
May 10, 2018 (JP) ..... JP2018-091524
Sep. 21, 2018 (KR) ..... 10-2018-0114136

(51) Int. Cl.
*F25D 17/04* (2006.01)

(52) U.S. Cl.
CPC ..... *F25D 17/045* (2013.01); *F25D 17/042* (2013.01); *F25D 2317/0415* (2013.01);
(Continued)

(58) Field of Classification Search
CPC .. F25D 17/045; F25D 17/042; F25D 2400/02; F25D 2317/0415;
(Continued)

(56) References Cited

U.S. PATENT DOCUMENTS 2,217,204 A * 10/1940 Jalma ..... F25D 17/042 62/78
2,222,882 A 11/1940 Shames
(Continued)

FOREIGN PATENT DOCUMENTS

DE 102007038354 A1 2/2009
JP H02254279 A 10/1990
(Continued)

OTHER PUBLICATIONS

ISA/KR, "International Search Report," International Application No. PCT/KR2018/013831, dated Mar. 14, 2019, 3 pages.
(Continued)

*Primary Examiner* — Emmanuel E Duke

(57) ABSTRACT

The present disclosure relates to a technique capable of being used even in an environment that needs to be maintained at a low temperature. The present disclosure may include a fan configured to generate a flow of air, an absorbing material disposed downstream from the fan and configured to absorb a malodorous substance from air passing therethrough and to desorb the malodorous substance by being heated, an upstream heater disposed downstream from the fan and upstream from the absorbing material and configured to heat air entered the absorbing material, a catalyst configured to decompose the malodorous substance desorbed from the absorbing material, and a cooler configured to cool air passed through the catalyst.

20 Claims, 31 Drawing Sheets

(52) U.S. Cl.
CPC .. *F25D 2317/063* (2013.01); *F25D 2317/067* (2013.01); *F25D 2317/0681* (2013.01); *F25D 2400/02* (2013.01)

(58) Field of Classification Search
CPC ..... F25D 2317/0681; F25D 2317/063; F25D 2317/067
See application file for complete search history.

(56) References Cited

U.S. PATENT DOCUMENTS

| | | | | |
|---|---|---|---|---|
| 2,604,760 | A | 7/1952 | Southern | |
| 2005/0067501 | A1* | 3/2005 | Kang | F25D 17/042 239/60 |
| 2014/0298835 | A1 | 10/2014 | Choi et al. | |

FOREIGN PATENT DOCUMENTS

| | | | | |
|---|---|---|---|---|
| JP | H05-168855 | A | | 7/1993 |
| JP | H06-011243 | A | | 1/1994 |
| JP | 2000005565 | A | | 1/2000 |
| JP | 2000-121162 | A | | 4/2000 |
| JP | 2002143632 | A | | 5/2002 |
| JP | 2003-666564 | | * | 4/2003 |
| KR | 20-2000-0011230 | U | | 6/2000 |
| KR | 10-2014-0122318 | A | | 10/2014 |

OTHER PUBLICATIONS

Supplementary European Search Report dated Oct. 13, 2020 in connection with European Patent Application No. 18 87 8131, 8 pages.
Office Action dated Mar. 12, 2020 in connection with India Patent Application No. 202017023955, 6 pages.

* cited by examiner

DEODORIZING APPARATUS AND REFRIGERATOR INCLUDING THE SAME

CROSS-REFERENCE TO RELATED APPLICATIONS

This application is based on and claims priority under 35 U.S.C. § 119 to Japanese Patent Application No. 2017-0221243 filed on Nov. 16, 2017, Japanese Patent Application No. 2018-091524 filed on May 10, 2018 in the Japanese Patent Office, and Korean Patent Application No. 10-2018-0114136 filed on Sep. 21, 2018 in the Korean Intellectual Property Office, the disclosures of which are incorporated by reference herein in its entirety.

BACKGROUND

1. Field

The present disclosure relates to a deodorizing apparatus and a refrigerator including the same.

2. Description of the Related Art

Typically, a deodorizing apparatus including an absorbing material such as activated carbon for absorbing a malodorous substance has been proposed. However, if the absorbing material reaches saturation, the absorption property of the absorbing material deteriorates. Accordingly, a material such as a catalyst capable of decomposing a malodorous substance is used.

For example, a deodorizing apparatus includes: an absorbing structure having an absorbent for absorbing a harmful material and desorbing it by being heated to be regenerated; and a catalyst structure formed by supporting (attachment to carriers) an oxidation catalyst for decomposing the harmful material desorbed from the absorbing structure, and having an electric heater for activating the oxidation catalyst upon regeneration, wherein passage forming means for forming an air passage for guiding the harmful material desorbed from the absorbing structure upon regeneration of the absorbing structure to the catalyst structure is installed to guide the harmful material desorbed from the absorbing structure upon regeneration to the catalyst structure through the passage forming means, and the catalyst structure decomposes the harmful material to a harmless material by the oxidation catalyst activated by the electric heater.

SUMMARY

To regenerate an absorber for absorbing a harmful material such as a malodorous substance, it may be necessary to activate a catalyst through a heater such as an electrical heater. When the absorber is regenerated, air passed through the catalyst may get warm. However, it may be not good to use warm air exiting a deodorizing apparatus in an environment, such as the inside of the refrigerating room of a refrigerator, which needs to be maintained at a low temperature.

Therefore, it is an aspect of the present disclosure to provide a deodorizing apparatus capable of being used in an environment that needs to be maintained at a low temperature, and a refrigerator including the deodorizing apparatus.

Additional aspects of the disclosure will be set forth in part in the description which follows and may be learned by practice of the disclosure.

In accordance with an aspect of the present disclosure, there is provided a refrigerator including: a refrigerating room configured to refrigerate goods; and a deodorizing apparatus disposed in the refrigerating room, wherein the deodorizing apparatus includes: a blower configured to generate a flow of air; an absorptive decomposer disposed downstream from the blower, and configured to absorb a malodorous substance from air passing therethrough and to decompose the malodorous substance by being heated; and a heater disposed downstream from the blower to heat the absorptive decomposer, or disposed downstream from the blower and upstream from the absorptive decomposer to heat air entered the absorptive decomposer.

The deodorizing apparatus may further include a suppressor configured to prevent air passed through the absorptive decomposer from being discharged to the outside of the deodorizing apparatus.

The deodorizing apparatus may further include a case configured to accommodate the blower, the heater, and the absorptive decomposer, wherein an inlet through which air enters and an outlet through which air exits are formed in the case. The suppressor may be configured to circulate air passed through the absorptive decomposer in the inside of the case in the state in which the inlet and the outlet are closed.

The deodorizing apparatus may further include: an opening/closing member configured to open or close the inlet and the outlet of the case in linkage with each other; and an opening/closing control member configured to control the opening/closing member to close the inlet and the outlet of the case when the heater heats the absorptive decomposer or air entered the absorptive decomposer.

The opening/closing control member may include a metal plate manufactured by coupling two kinds of metals having different thermal expansion rates with each other.

The deodorizing apparatus may further include a member configured to transfer heat from the heater to the opening/closing control member.

The heater may heat the absorptive decomposer without making contact with the absorptive decomposer.

The deodorizing apparatus may further include at least one processor configured to control driving of the blower. The at least one processor may be configured to control driving of the blower to reduce an air volume when the heater heats air compared to when the heater does not heat air.

The heater may be configured to heat the absorptive decomposer in contact with the absorptive decomposer.

The deodorizing apparatus may further include at least one processor configured to control driving of the blower. The at least one processor may control driving of the blower such that the blower stops when the heater heats air.

The absorptive decomposer may include: an absorber disposed downstream from the blower, and configured to absorb a malodorous substance from air passing therethrough and to desorb the malodorous substance by being heated; and a decomposer configured to decompose the malodorous substance desorbed from the absorber.

The deodorizing apparatus may further include a cooler configured to cool air passed through the decomposer.

The deodorizing apparatus may further include at least one processor configured to control driving of the blower. The at least one processor may be configured to control driving of the blower to reduce an air volume when the heater heats air compared to when the heater does not heat air.

The deodorizing apparatus may further include: a decomposing heater configured to heat the decomposer; and a cooling heat sink disposed downstream from the decomposer, and configured to cool air passed through the decomposer.

The deodorizing apparatus may further include a heating heat sink disposed downstream from the blower and upstream from the absorber, and configured to heat air sent by the blower.

The cooler may include a heat exchange device disposed between the cooling heat sink and the heating heat sink, and configured to absorb heat at the cooling heat sink and to radiate heat at the heating heat sink.

The deodorizing apparatus may further include a case configured to accommodate the absorber, the decomposer, and the cooler, wherein an inlet through which air enters and an outlet through which air exits are formed in the case, and a path of air from the inlet to the outlet is a "U" shape.

In accordance with an aspect of the present disclosure, there is provided a deodorizing apparatus including: a blower configured to generate a flow of air; an absorptive decomposer disposed downstream from the blower, and configured to absorb a malodorous substance from air passing therethrough and to decompose the malodorous substance by being heated; and a heater disposed downstream from the blower to heat the absorptive decomposer, or disposed downstream from the blower and upstream from the absorptive decomposer to heat air entered the absorptive decomposer.

The absorptive decomposer may include: an absorber disposed downstream from the blower, and configured to absorb a malodorous substance from air passing therethrough and to desorb the malodorous substance by being heated; and a decomposer configured to decompose the malodorous substance desorbed from the absorber.

The deodorizing apparatus may further include a suppressor configured to prevent air passed through the absorptive decomposer from being discharged to the outside of the deodorizing apparatus.

Also, the deodorizing apparatus may include: a blower configured to generate a flow of air; an absorber disposed downstream from the blower and configured to absorb a malodorous substance from air passing therethrough and to desorb the malodorous substance by being heated; a upstream heater disposed downstream from the blower and upstream from the absorber, and configured to heat entered the absorber; a decomposer configured to decompose the malodorous substance desorbed from the absorber; and a cooler configured to cool air passed through the decomposer.

The deodorizing apparatus may include: a blower configured to generate a flow of air; an absorptive decomposer disposed downstream from the blower, and configured to absorb a malodorous substance from air passing therethrough and to decompose the malodorous substance by being heated; a heater disposed downstream from the blower to heat the absorptive decomposer, or disposed downstream from the blower and upstream from the absorptive decomposer to heat air entered the absorptive decomposer; and a suppressor configured to prevent air passed through the absorptive decomposer from being discharged to the outside of the deodorizing apparatus.

The absorptive decomposer may include: an absorber disposed downstream from the blower, and configured to absorb a malodorous substance from air passing therethrough and to desorb the malodorous substance by being heated; and a decomposer configured to decompose the malodorous substance desorbed from the absorber.

The opening/closing member may be configured with one component.

The deodorizing apparatus may further include a component installed around the heater and configured to improve a heat transfer effect and safety.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1A through 18B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, embodiments of the present disclosure will be described in detail with reference to the accompanying drawings.

Figure 1A:
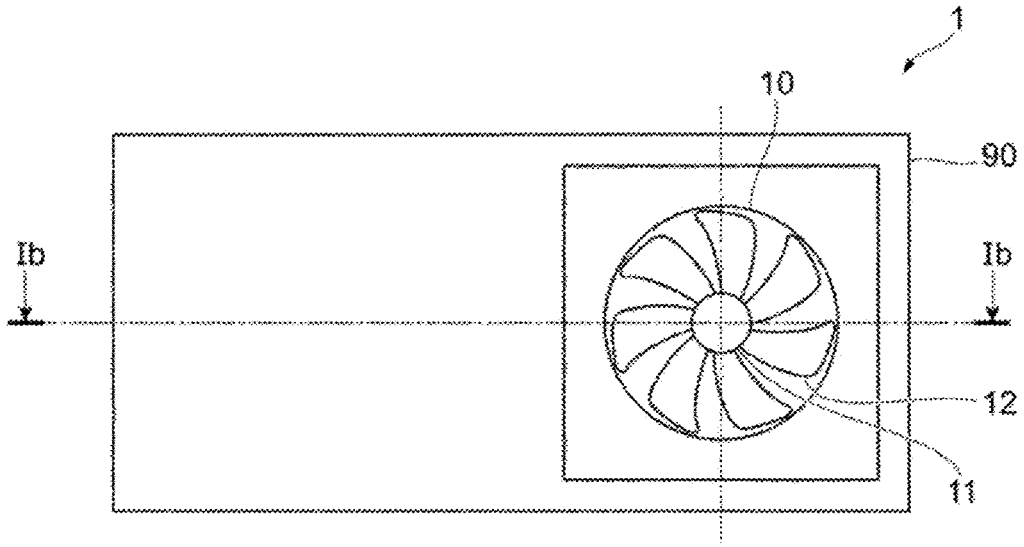
FIG. 1A is a front view illustrating an outer appearance of a deodorizing apparatus according to an embodiment.
Figure 1B:
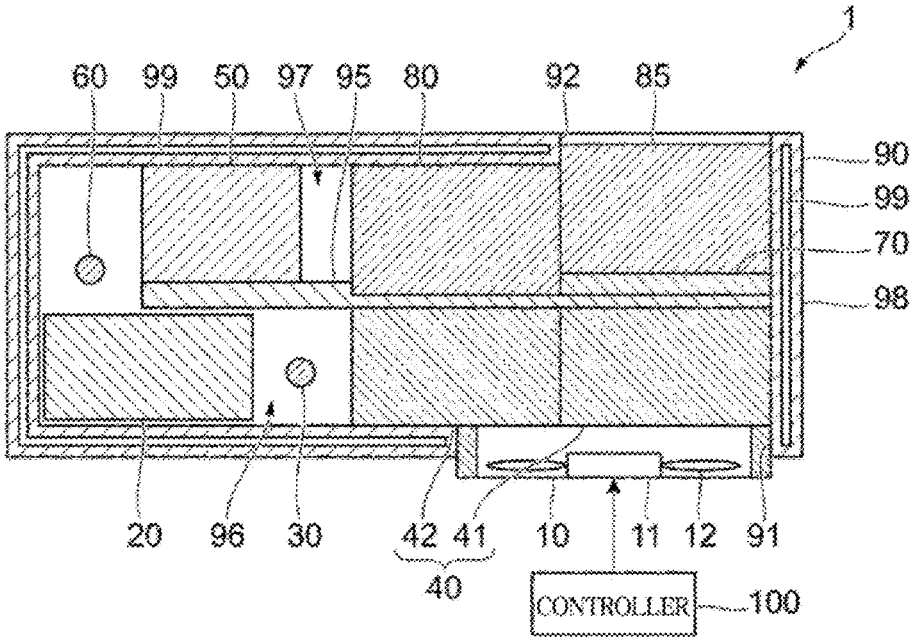
FIG. 1B is a schematic configuration view illustrates the inside of the deodorizing apparatus from a cross section of the deodorizing apparatus taken along line Ib-Ib of FIG. 1A.

FIG. 1A is a front view illustrating an outer appearance of a deodorizing apparatus 1 according to an embodiment, and FIG. 1B is a schematic configuration view illustrating the inside of the deodorizing apparatus 1 from a cross section of the deodorizing apparatus 1 taken along line Ib-Ib of FIG. 1A.

The deodorizing apparatus 1 according to an embodiment may include a fan 10 which is an example of a blower for generating a flow of air, and an absorbing material 20 disposed downstream from the fan 10 and being an example of an absorber that absorbs a malodorous substance from air passing therethrough and desorbs the malodorous substance by being heated.

Also, the deodorizing apparatus 1 may include an upstream heater 30 disposed downstream from the fan 10 and upstream from the absorbing material 20 and being an example of an upstream heating device for heating air entered the absorbing material 20, and a heating heat sink 40 for heating air sent by the fan 10.

Also, the deodorizing apparatus 1 may include a catalyst 50 which is an example of a decomposer for decomposing the malodorous substance desorbed from the absorbing material 20, a downstream heater 60 which is an example of a decomposing heater for heating the catalyst 50, and a cooler 70 which is an example of a cooling device for cooling air passed through the catalyst 50.

Also, the deodorizing apparatus 1 may include a heat-retentive heat sink 80 disposed downstream from the catalyst 50 to hold heat for activating the catalyst 50, and a cooling heat sink 85 disposed downstream from the heat-retentive heat sink 80 to cool air passed through the heat-retentive heat sink 80.

Also, the deodorizing apparatus 1 may include a case 90 formed in the shape of a rectangular parallelepiped for accommodating the absorbing material 20, the upstream heater 30, the heating heat sink 40, the catalyst 50, the downstream heater 60, the cooler 70, the heat-retentive heat sink 80, and the cooling heat sink 85, wherein an inlet 91 through which air enters and an outlet 92 through which air exits may be formed in the case 90. The case 90 may include a partition wall 95 which spaces the inlet 91 apart from the outlet 92 so that a flow path of air entered through the inlet 91 and exiting through the outlet 92 turns around, while causing air passed through the absorbing material 20 to move toward the catalyst 50. By forming the partition wall 95, the case 90 may have a U-shaped path of air from the inlet 91 to the outlet 92.

Also, the deodorizing apparatus 1 may include a controller 100 including at least one processor for controlling driving of the fan 10, operations of the upstream heater 30, operations of the downstream heater 60, operations of the cooler 70, etc.

The deodorizing apparatus 1 according to an embodiment may be an apparatus capable of switching between an absorption mode for absorbing a malodorous substance existing in air through the absorbing material 20 and a regeneration mode for desorbing the malodorous substance from the absorbing material 20 to regenerate the absorbing material 20 and decomposing the desorbed malodorous substance through the catalyst 50. Also, the deodorizing apparatus 1 may perform the absorption mode and the regeneration mode alternately, and maintain high deodorizing capability of the absorbing material 20 for a long time.

Hereinafter, components included in the deodorizing apparatus 1 will be described in detail.

The fan 10 may be disposed in the inlet 91 of the case 90. The fan 10 may include a rotation shaft 11, a plurality of blades 12 arranged around the rotation shaft 11, and a motor (not shown) for rotating the rotation shaft 11. In the fan 10 according to an embodiment, the rotation shaft 11 may be disposed in a front-rear direction as seen in FIG. 1A, and in an up-down direction as seen in FIG. 1B. Also, the fan 10 may introduce outside air to the inside of the case 90 through the inlet 91, and discharge the inside air to the outside of the case 90 through the outlet 92. The revolutions per minute (rpm) of the motor may be controlled by the controller 100.

The absorbing material 20 may include activated carbon for absorbing a malodorous substance existing in air passing therethrough to perform deodorization, and desorbing the malodorous substance by being heated.

The upstream heater 30 may be disposed upstream from the absorbing material 20 and downstream from the heating heat sink 40. When electricity is supplied to the upstream heater 30 for a predetermined time, the upstream heater 30 may heat the absorbing material 20 or air entered the absorbing material 20 to a predetermined temperature at which the malodorous substance absorbed in the absorbing material 20 may be desorbed. The supply of electricity to the upstream heater 30 may be controlled by the controller 100.

The heating heat sink 40 may include an upstream heating heat sink 41 disposed upstream and a downstream heating heat sink 42 disposed downstream.

The upstream heating heat sink 41 and the downstream heating heat sink 42 may be molded with a metal, such as aluminum, iron, and copper, having good heat transfer characteristics.

The catalyst 50 may be a catalyst-supported filter in which an oxidation catalyst is supported on both sides of a substrate having high heat conductivity. The oxidation catalyst may be one or more kinds of metals selected from among Ag, Pd, Pt, Mn, Rh, Fe, and Co, or metal oxide thereof.

The downstream heater 60 may be disposed downstream from the absorbing material 20 and upstream from the catalyst 50. When electricity is supplied to the downstream heater 60 for a predetermined time, the downstream heater 60 may heat the catalyst 50 or air entered the catalyst 50 to a predetermined temperature at which a malodorous substance desorbed from the absorbing material 20 may be decomposed. The supply of electricity to the downstream heater 60 may be controlled by the controller 100.

The cooler 70 may include an electronic device having a heat exchange function, such as a peltier element, which is disposed between the cooling heat sink 85 and the heating heat sink 40, absorbs heat at the cooling heat sink 85, and radiates heat at the heating heat sink 40 in a turned-on state. The cooler 70 may be turned on/off by the controller 100.

The heat-retentive heat sink 80 may be opposite to the downstream heating heat sink 42 through the partition wall 95.

The cooling heat sink 85 may be opposite to the upstream heating heat sink 41 through the partition wall 95. The cooler 70 may be disposed between the cooling heat sink 85 and the partition wall 95.

The heat-retentive heat sink 80 and the cooling heat sink 85 may be molded with a metal, such as aluminum, iron, and copper, having good heat transfer characteristics.

The case 90 may include a first accommodating room 96 formed close to the inlet 91 with respect to the partition wall 95, and a second accommodating room 97 formed close to the outlet 92 with respect to the partition wall 95.

In the first accommodating room 96, the upstream heating heat sink 41, the downstream heating heat sink 42, the upstream heater 30, and the absorbing material 20 may be disposed in this order from the inlet 91.

In the second accommodating room 97, the cooling heat sink 85, the heat-retentive heat sink 80, the catalyst 50, and the downstream heater 60 may be disposed in this order from the outlet 92.

The upstream heating heat sink 41 may be opposite to the cooling heat sink 85 through the partition wall 95, and the downstream heating heat sink 42 may be opposite to the heat-retentive heat sink 80 through the partition wall 95. The upstream heater 30 may be disposed between the downstream heating heat sink 42 and the absorbing material 20, and the downstream heater 60 may be disposed between the absorbing material 20 and the catalyst 50.

Through the above-described arrangement, air entered the inside of the case 90 through the inlet 91 by the fan 10 may pass through the upstream heating heat sink 41, the downstream heating heat sink 42, the upstream heater 30, the absorbing material 20, the downstream heater 60, the catalyst 50, the heat-retentive heat sink 80, and the cooling heat sink 85 in this order, and then be discharged to the outside of the case 90 through the outlet 92.

An outer wall 98 of the case 90 may be a double-layer structure having an air layer 99 in the inside. Therefore, the inside of the case 90 may be insulated from the outside.

Figure 2:
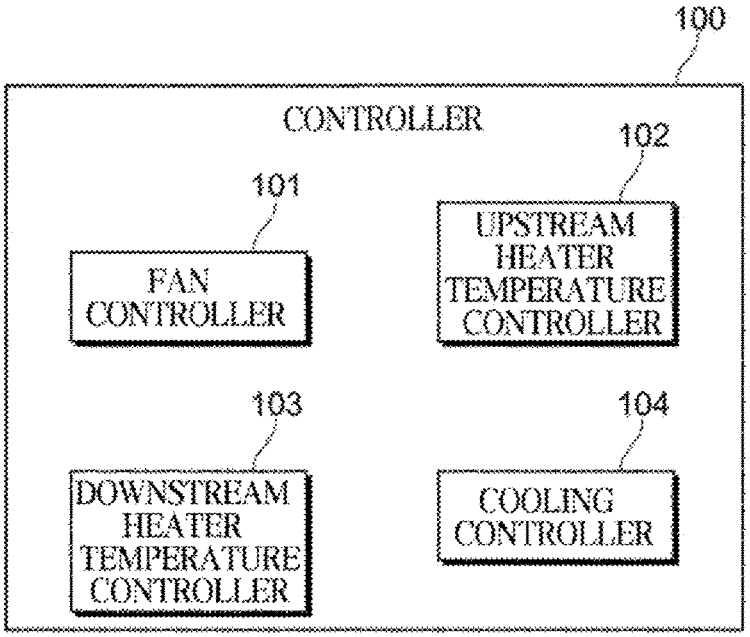
FIG. 2 illustrates a block diagram of a controller.

FIG. 2 illustrates a block diagram of the controller 100.

The controller 100 may include a fan controller 101 for controlling the rpm of a motor (not shown) for rotating the fan 10, a upstream heater temperature controller 102 for controlling a temperature of the upstream heater 30, a downstream heater temperature controller 103 for controlling a temperature of the downstream heater 60, and a cooling controller 104 for controlling on/off of the cooler 70.

The controller 100 may include at least one processor. The controller 100 may include a Central Processing Unit (CPU) (not shown) for arithmetic processing, Read Only Memory (ROM) (not shown) for storing programs or various data that is executed by the CPU, and Random Access Memory (RAM) (not shown) used as memory for tasks of the CPU. Also, the CPU may execute a program to implement the fan controller 101, the upstream heater temperature controller 102, the downstream heater temperature controller 103, and the cooling controller 104.

The fan controller 101 may convert the rpm of the fan 10 to two levels of high speed and low speed. However, the fan controller 101 may convert the rpm of the fan 10 to three or more levels or continuously. The fan controller 101 may convert the rpm of the fan 10 to high speed in the absorption mode, and in the regeneration mode, the fan controller 101 may convert the rpm of the fan 10 to low speed.

When the fan controller 101 converts the rpm of the fan 10 to low speed (in the regeneration mode), the upstream heater temperature controller 102 may supply electricity to the upstream heater 30 for a predetermined time to raise the temperature of the upstream heater 30 to a predetermined temperature. Meanwhile, when the fan controller 101 converts the rpm of the fan 10 to low speed (in the absorption mode), the upstream heater temperature controller 102 may supply no electricity to the upstream heater 30.

When the fan controller 101 converts the rpm of the fan 10 to low speed (in the regeneration mode), the downstream heater temperature controller 103 may supply electricity to the downstream heater 60 for a predetermined time to raise the temperature of the downstream heater 60 to a predetermined temperature. Meanwhile, when the fan controller 101 converts the rpm of the fan 10 to high speed (in the absorption mode), the downstream heater temperature controller 103 may supply no electricity to the downstream heater 60.

When the fan controller 101 converts the rpm of the fan 10 to low speed (in the regeneration mode), the cooling controller 104 may turn on the cooler 70, and when the fan controller 101 converts the rpm of the fan 10 to high speed (in the absorption mode), the cooling controller 104 may turn off the cooler 70.

Figure 3:
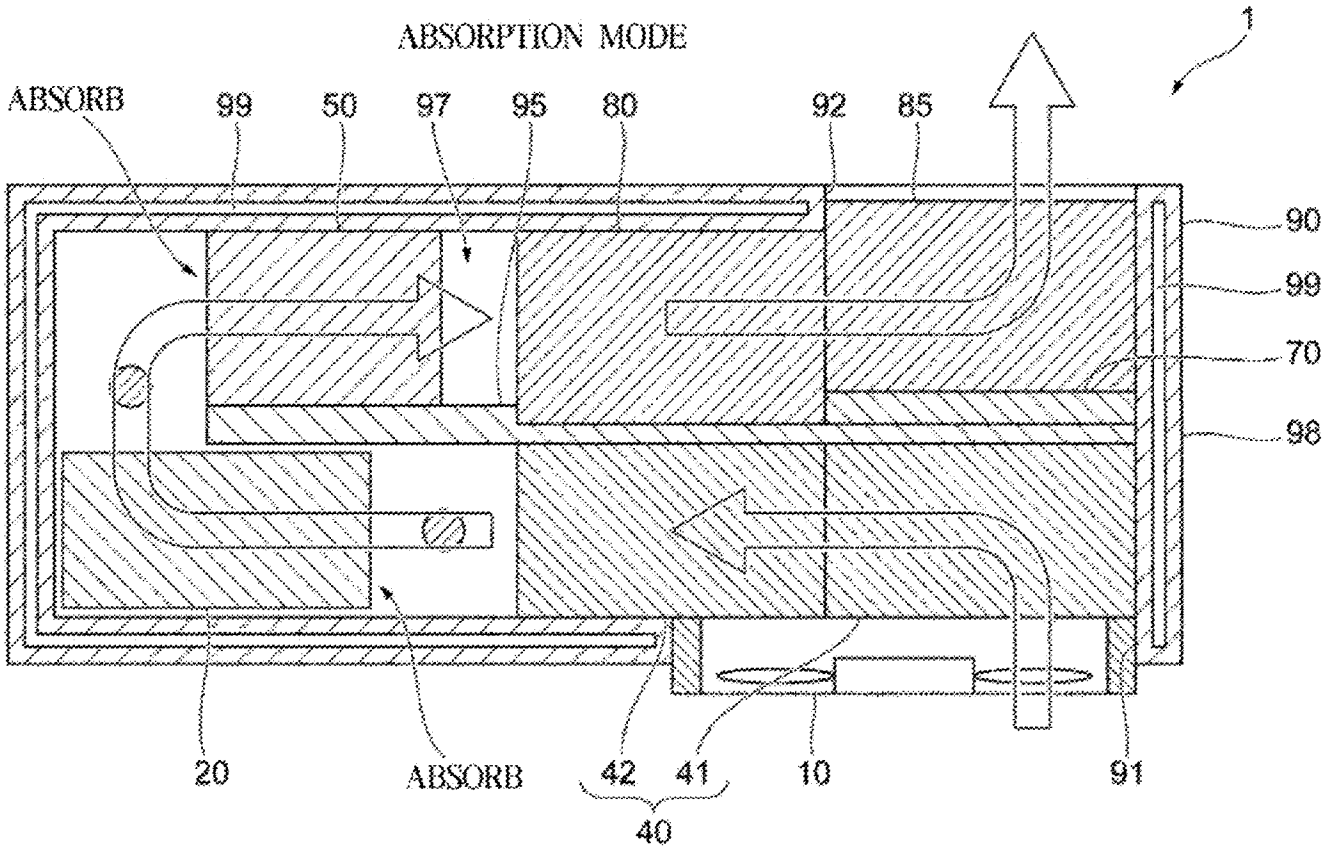
FIG. 3 illustrates a flow of air when the deodorizing apparatus is in an absorption mode.

FIG. 3 illustrates a flow of air when the deodorizing apparatus 1 is in the absorption mode.

Figure 4:
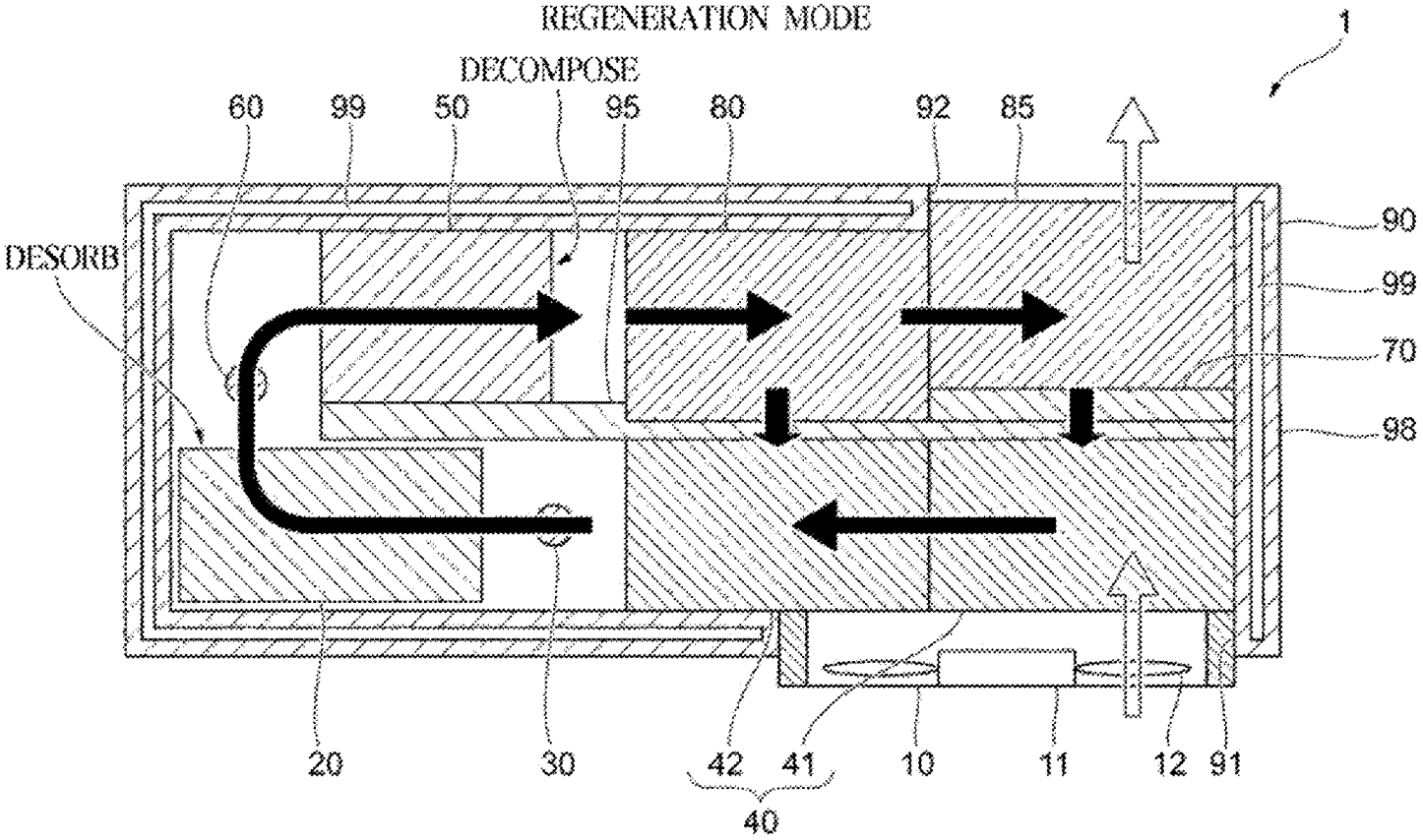
FIG. 4 illustrates a flow of air and a movement of heat when the deodorizing apparatus is in a regeneration mode.

FIG. 4 illustrates a flow of air and a movement of heat when the deodorizing apparatus 1 is in the regeneration mode.

When the deodorizing apparatus 1 according to an embodiment is in the absorption mode, the fan controller 101 may convert the rpm of the fan 10 to high speed, and the cooling controller 104 may turn off the cooler 70. Also, the upstream heater temperature controller 102 and the downstream heater temperature controller 103 may supply no electricity to the upstream heater 30 and the downstream heater 60 so as not to raise the temperature of the upstream heater 30 and the downstream heater 60. At this time, air inhaled into the inside of the case 90 by the fan 10 may pass through the first accommodating room 96 and the second accommodating room 97 and then be discharged through the outlet 92. At this time, a malodorous substance included in the air may be absorbed into the absorbing material 20. Also, when the catalyst 50 is a catalyst-supported filter, the malodorous substance included in the air may also be absorbed into the catalyst 50.

Meanwhile, in the deodorizing apparatus 1, the fan controller 101 may convert the rpm of the fan 10 to low speed in the regeneration mode by taking into consideration that a decomposition rate of a malodorous substance by the catalyst 50 is slower than an absorption rate of the absorbing material 20. The cooling controller 104 may turn on the cooler 70, and the upstream heater temperature controller 102 and the downstream heater temperature controller 103 may supply electricity to the upstream heater 30 and the downstream heater 60, respectively, to raise the temperature of the upstream heater 30 and the downstream heater 60. At this time, likewise, air inhaled into the inside of the case 20 by the fan 10 may pass through the first accommodating room 96 and the second accommodating room 97 to be discharged through the outlet 92, wherein the passing speed of the air may be lower than the passing speed of air in the absorption mode.

The absorbing material 20 may get warm by the upstream heater 30 and the downstream heater 60, and also air got warm by the upstream heating heat sink 41 and the downstream heating heat sink 42 may enter the absorbing material 20. Therefore, the absorbing material 20 may be heated to desorb the malodorous substance. Accordingly, the absorbing material 20 may be regenerated.

The catalyst 50 may get warm by the downstream heater 60, and air got warm by the upstream heating heat sink 41 and the downstream heating heat sink 42 and then passed through the absorbing material 20 may enter the catalyst 50. Therefore, the catalyst 50 may be heated and activated to decompose the malodorous substance desorbed from the absorbing material 20. Also, when the catalyst 50 is a catalyst-supported filter, the catalyst 50 may decompose the malodorous sub stance absorbed therein.

The air passed through the catalyst 50 may enter the heat-retentive heat sink 80. The heat-retentive heat sink 80 may maintain a high temperature. Heat around the heat-retentive heat sink 80 may be transferred to the opposite downstream heating heat sink 42 through the partition wall 95. Accordingly, the heat may raise the temperature of the downstream heating heat sink 42 to raise the temperature of air that enters the absorbing material 20.

Air passed through the heat-retentive heat sink 80 may enter the cooling heat sink 85. Since the cooler 70 is in a turned-on state when the deodorizing apparatus 1 is in the regeneration mode, the cooler 70 may absorb heat at the cooling heat sink 85, and radiate heat at the upstream heating heat sink 41. That is, the cooler 70 may lower the temperature of the cooling heat sink 85 and raise the temperature of the upstream heating heat sink 41. As a result, air that is to be discharged through the outlet 92 may be cooled by the cooling heat sink 85. Meanwhile, when the temperature of the upstream heating heat sink 41 increases, the temperature of air entered the downstream heating heat sink 42 and the absorbing material 20 may increase.

As described above, in the deodorizing apparatus 1 according to an embodiment, deodorization (removing a malodorous substance) may be performed by the absorbing material 20 to thereby achieve high absorption speed while saving energy. Also, since the deodorizing apparatus 1 according to an embodiment regenerates the absorbing material 20, the deodorizing apparatus 1 may maintain the absorption capability (deodorizing capability) of the absorbing material 20 for a long time, compared with a case in which an absorbing material is not regenerated. Also, since the catalyst 50 is used for regeneration and a malodorous substance concentrated in the absorbing material 20 is exposed to the catalyst 50, it may be possible to increase a decomposition rate. Although the inside temperature of the case 90 increases to regenerate the absorbing material 20, air that is to be discharged through the outlet 92 may be cooled by operation of the cooler 70 and the cooling heat sink 85. Also, since the outer wall 98 of the case 90 is a double-layer structure having the air layer 99 in the inside, the inside of the case 90 may be insulated from the outside. Therefore, the deodorizing apparatus 1 may not discharge heat used for heating. As a result, the deodorizing apparatus 1 according to an embodiment may be used in an environment, such as the inside of the refrigerating room of a refrigerator, which needs to be maintained at a low temperature.

Meanwhile, in the deodorizing apparatus 1 described above, a timing of conversion between the absorption mode and the regeneration mode so that the absorption mode and the regeneration mode are performed alternately may be not limited to a specific timing. For example, the deodorizing apparatus 1 may convert the absorption mode to the regeneration mode after the absorption mode is performed for a predetermined absorption mode period, and then convert the regeneration mode to the absorption mode after the regeneration mode is performed for a predetermined regeneration mode period. The predetermined absorption mode period may be equal to or different from the predetermined regeneration mode period.

Also, the deodorizing apparatus 1 may include an odor sensor (not shown) for detecting an odor. For example, the odor sensor may be disposed downstream from the absorbing material 20, and when an amount of odor detected by the odor sensor is equal to or more than a predetermined amount, the deodorizing apparatus 1 may convert the absorption mode to the regeneration mode. In this case, the deodorizing apparatus 1 may perform the regeneration mode for the predetermined regeneration mode period, and then convert the regeneration mode to the absorption mode.

Figure 5A:
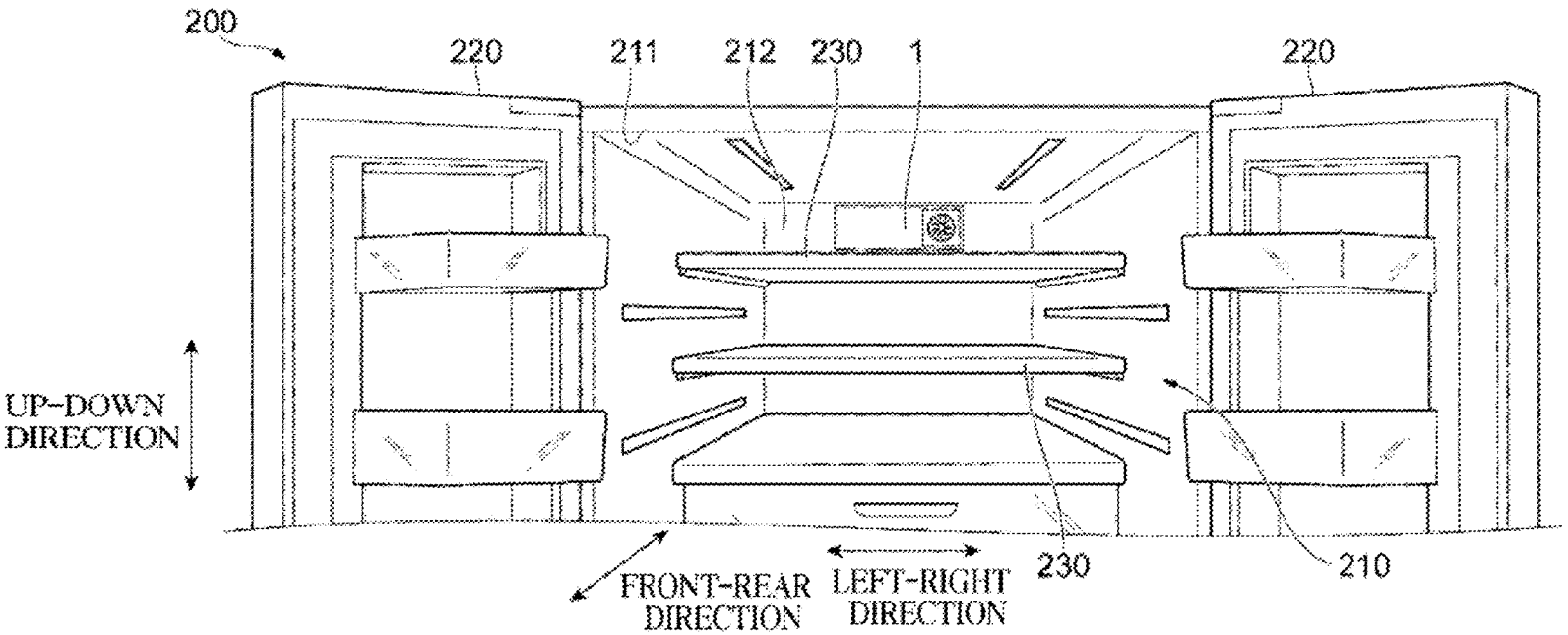
FIG. 5A illustrates a schematic front view of a refrigerator to which the deodorizing apparatus according to an embodiment is applied.
Figure 5B:
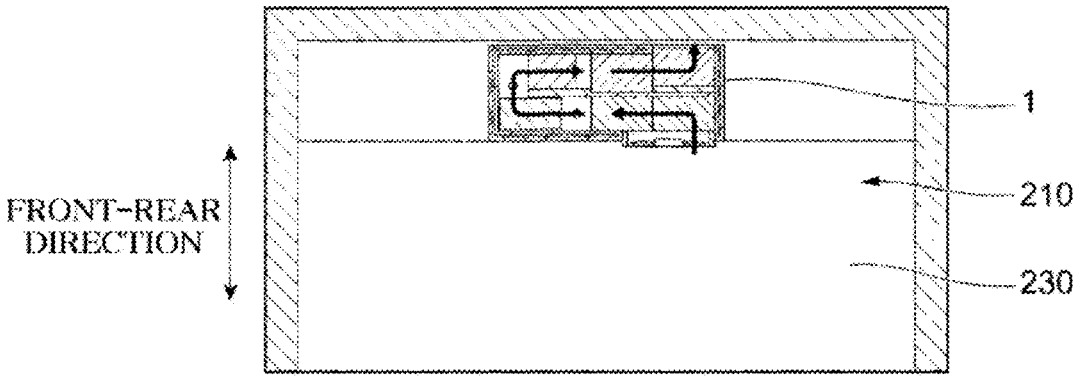
FIG. 5B illustrates the inside of a refrigerating room of the refrigerator from above.

FIG. 5A illustrates a schematic front view of a refrigerator 200 to which the deodorizing apparatus 1 according to an embodiment is applied, and FIG. 5B illustrates the inside of a refrigerating room of the refrigerator 200 from above.

The refrigerator 200 may include, as shown in FIG. 5A, a refrigerating room 210 for refrigerating goods, a door 220 for opening and closing the refrigerating room 210, a plurality of shelves 230 on which goods are put, and the deodorizing apparatus 1.

The deodorizing apparatus 1 may be disposed between the uppermost shelf 230 among the plurality of shelves 230 and an upper wall 211 partitioning the refrigerating room 210, as shown in FIG. 5A. Also, the deodorizing apparatus 1 may be, as shown in FIG. 5B, disposed in the inner side of the refrigerating room 210, that is, closer to a rear wall 212 forming the refrigerating room 210 than the door 220. Also, the deodorizing apparatus 1 may be disposed such that the inlet 91 of the case 90 on which the fan 10 is disposed is located in the front portion and the outlet 92 of the case 90 is located in the rear portion.

Also, when the deodorizing apparatus 1 is in the absorption mode, the deodorizing apparatus 1 may inhale air in the refrigerating room 210 in the front portion, absorb a malodorous substance in the air, and discharge the air from the rear portion. Thereby, the deodorizing apparatus 1 may remove the malodorous substance from the air in the refrigerating room 210.

Meanwhile, when the deodorizing apparatus 1 is in the regeneration mode, the deodorizing apparatus 1 may regenerate the absorbing material 20. When the absorbing material 20 is regenerated, air in the case 90 may be heated, however, air that is to be discharged through the outlet 92 of the case 90 may be cooled since the cooler 70 and the cooling heat sink 85 are provided. Therefore, the temperature of the refrigerating room 210 may be maintained at a low temperature.

Meanwhile, in the deodorizing apparatus 1 disposed in the refrigerating room 210, a timing of conversion between the absorption mode and the regeneration mode so that the absorption mode and the regeneration mode are performed alternately may be not limited to a specific timing. For example, the deodorizing apparatus 1 may perform the absorption mode during a time for which the door 220 of the refrigerator 200 is often opened and closed, and during a time for which the door 220 of the refrigerator 200 is rarely opened and closed, the deodorizing apparatus 1 may perform the regeneration mode. The time for which the door 220 of the refrigerator 200 is often opened and closed may be a predetermined time (for example, a time between 7 A.M. and 9 P.M.), and the time for which the door 220 of the refrigerator 200 is rarely opened and closed may be a time set by a user. Also, the time for which the door 220 of the refrigerator 200 is rarely opened and closed may be a predetermined time (for example, a time between 9 P.M. and 7 A.M.), or a time set by a user.

A deodorizing apparatus 1 according to an embodiment may not include the cooler 70, unlike the deodorizing apparatus 1 according to an embodiment.

In the deodorizing apparatus 1 according to an embodiment having a configuration in which no cooler 70 is included between the cooling heat sink 85 and the upstream heating heat sink 41, heat exchange may be performed by the cooling heat sink 85. Therefore, although the inside temperature of the case 90 rises in the regeneration mode, air that is to be discharged through the outlet 92 may be cooled by operation of the cooling heat sink 85. As a result, the deodorizing apparatus 1 according to an embodiment may not radiate heat used for heating. Accordingly, the deodorizing apparatus 1 according to an embodiment may be used in an environment, such as the inside of the refrigerating room of a refrigerator, which needs to be maintained at a low temperature.

Figure 6A:
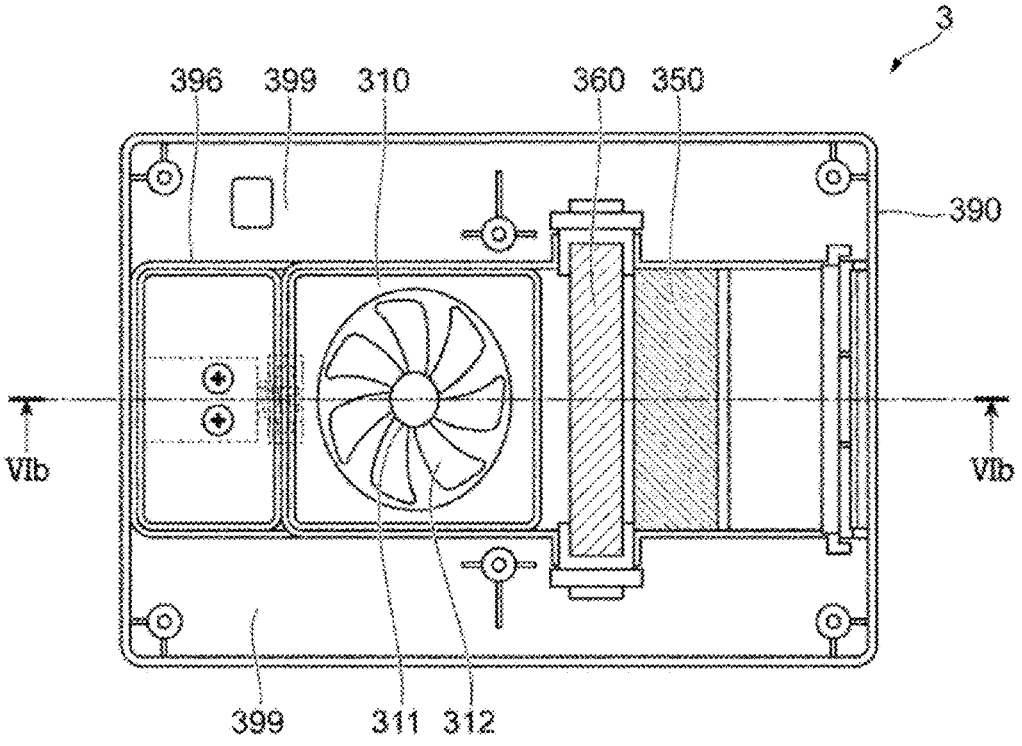
FIG. 6A illustrates a top view of a deodorizing apparatus according to an embodiment.
Figure 6B:
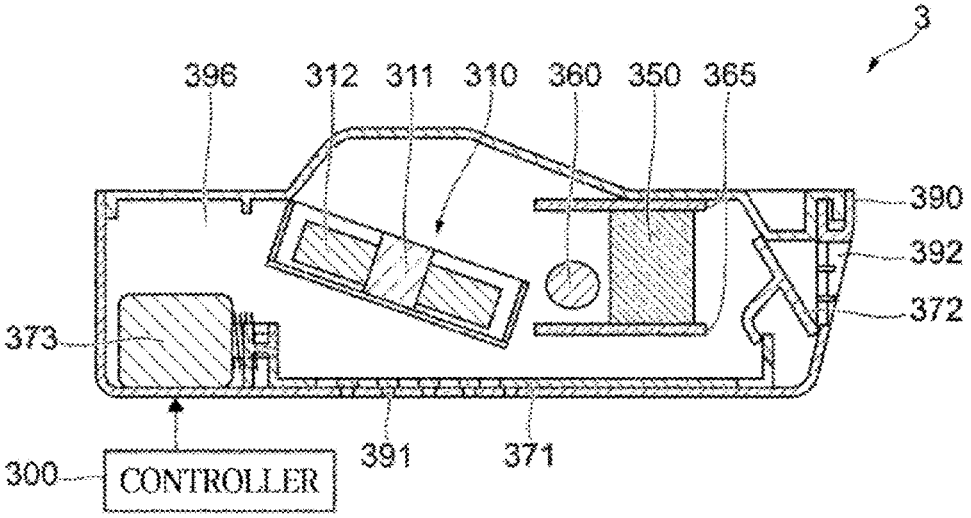
FIG. 6B a schematic configuration view illustrating the inside of the deodorizing apparatus from a cross section of the deodorizing apparatus taken along line VIb-VIb of FIG. 6A.

FIG. 6A illustrates a top view of a deodorizing apparatus 3 according to an embodiment. The top view of FIG. 6A illustrates a part of an internal structure of the deodorizing apparatus 3. FIG. 6B is a schematic configuration view illustrating the inside of the deodorizing apparatus 3 from a cross section of the deodorizing apparatus 3 taken along line VIb-VIb of FIG. 6A.

The deodorizing apparatus 3 according to an embodiment may include a fan 310 which is an example of a blower for generating a flow of air.

Also, the deodorizing apparatus 3 may include a catalyst 350 disposed downstream from the fan 310 and being an example of an absorptive decomposer for absorbing a malodorous substance from air passing therethrough and decomposing the malodorous substance by being heated, a heater 360 which is an example of a heating device for heating air entered the catalyst 350, and a metal component 365 which is an example of a component for improving the heat transfer effect and safety.

Also, the deodorizing apparatus 3 may include a shutter 371 and a damper 372 which are an opening/closing mechanism as an example of a suppressor for preventing air passed through the catalyst 350 from being discharged to the outside, and a solenoid 373 for performing opening and closing operations of the shutter 371 and the damper 372.

Also, the deodorizing apparatus 3 may include a case 390 formed in the shape of a rectangular parallelepiped for accommodating the fan 310, the catalyst 350, the heater 360, the metal component 365, the shutter 371, the damper 372, and the solenoid 373, wherein an inlet 391 through which air enters and an outlet 392 through which air exits may be formed in the case 390.

Also, the deodorizing apparatus 3 may include a controller 300 including at least one processor for controlling driving of the fan 310, operations of the heater 360, driving of the solenoid 373, etc.

The deodorizing apparatus 3 according to an embodiment may be an apparatus capable of switching between an absorption mode for absorbing a malodorous substance existing in air through the catalyst 350 and a regeneration mode for decomposing the absorbed malodorous substance through the catalyst 350 to regenerate the catalyst 350. The deodorizing apparatus 3 may perform the absorption mode and the regeneration mode alternately, and maintain high deodorizing capability of the catalyst 350 for a long time.

Hereinafter, the components included in the deodorizing apparatus 3 will be described in detail.

The fan 310 may include a rotation shaft 311, a plurality of blades 312 arranged around the rotation shaft 311, and a motor (not shown) for rotating the rotation shaft 311. In the fan 310 according to an embodiment, the rotation shaft 311 may be disposed in a front-rear direction in such a way to be a little tilted downward in a right direction, as seen in FIG. 6A, and as seen in FIG. 6B, the rotation shaft 311 may be disposed in an up-down direction in such a way to be a little tilted downward in the right direction. Also, the fan 310 may introduce outside air to the inside of the case 390 through the inlet 391, and also cause the air to flow to the catalyst 350. The rpm of the motor may be controlled by the controller 300.

The catalyst 350 may be a porous structure having a gas absorption function, and may be a catalyst-supported filter in which an oxidation catalyst is supported on both sides of a substrate having high heat conductivity. The oxidation catalyst may be one or more materials selected from among Ag, Pd, Pt, Mn, Rh, Fe, Co, I, P, Ti, and K, or oxides of the materials. The oxidation catalyst may remove or reduce a malodorous component of by-products that may be generated in a process of decomposing a malodorous component absorbed in the catalyst-supported filter. For example, methyl disulfide $(CH_3)_2S_2$ that may be generated in a process of decomposing methyl mercaptan $CH_3SH$ has a low odor compared with the methyl mercaptan $CH_3SH$. The catalyst 350 may be a photocatalyst.

The heater 360 may be disposed downstream from the fan 310 and upstream from the catalyst 350. When electricity is supplied to the heater 360 for a predetermined time, the heater 360 may raise the temperature of air entered the catalyst 350 to a predetermined temperature at which a malodorous substance absorbed in the catalyst 350 may be decomposed. The supply of electricity to the heater 360 may be controlled by the controller 300. Meanwhile, the heater 360 may be a dedicated heater that operates by power supplied from the main body of the refrigerator, not a defrosting heater included in the main body of the refrigerator, to prevent the deodorizing apparatus 3 from interfering with a refrigerating cycle. Also, the temperature of the heater 360 for activating the catalyst 350 may be 100° C. or lower. That is, the heater 360 may use a temperature that may be applied to home appliances (particularly, refrigerators). Although the catalyst 350 has decomposition capability even under a low temperature condition, the decomposition capability of the catalyst 350 may be improved when the catalyst 350 is activated under the condition of high-temperature (equal to or lower than 100° C.) heating.

The metal component 365 may be installed around the heater 360 and the catalyst 350 to improve the heat transfer effect and safety. The metal component 365 may use, for example, SUS.

The shutter 371 may be disposed along a bottom of the case 390. The shutter 371 may have a hole having the same size as the inlet 391 formed in the bottom of the case 390 and disposed to correspond to the inlet 391. The shutter 371 may slide along the bottom of the case 390.

The damper 372 may be disposed around the outlet 392 in the inside of the case 390. The damper 372 may rotate when the shutter 371 slides along the bottom of the case 390.

That is, the shutter 371 and the damper 372 may be an example of an opening/closing member for opening and closing the inlet 391 and the outlet 392.

The solenoid 373 may be disposed at a location at which it does not interfere with a flow of air in the inside of the case 390. When the solenoid 373 is in an on state, the solenoid 373 may cause the shutter 371 to slide along the bottom of the case 390 to close the inlet 391 to prevent air from entering the case 390, and also, the solenoid 373 may rotate the damper 372 to close the outlet 392 to prevent air from being discharged to the outside. That is, the solenoid 373 may be an example of an opening/closing control member for controlling the shutter 371 and the damper 372 to close the inlet 391 and the outlet 392 when the heater 360 heats air. The solenoid 373 may be turned on/off by the controller 300. Meanwhile, the drawings show a state in which when the solenoid 373 is in the on state, the inlet 391 and the outlet 392 are closed.

The case 390 may have an accommodating room 396 in the central portion in which the inlet 391 and the outlet 392 are formed.

In the accommodating room 396, the shutter 371, the fan 310, the heater 360, the catalyst 350, and the damper 372 may be arranged in this order from the inlet 391.

According to the above-described arrangement, air entered the inside of the case 390 through the inlet 391 by the fan 310 may pass through the heater 360 and the catalyst 350 in this order to be discharged to the outside of the case 390 through the outlet 392 or to circulate in the inside of the case 390.

The case 390 may be a double-layer structure having an air layer 399 in both sides of the accommodating room 396. Therefore, the inside of the case 390 may be insulated from the outside.

Figure 7:
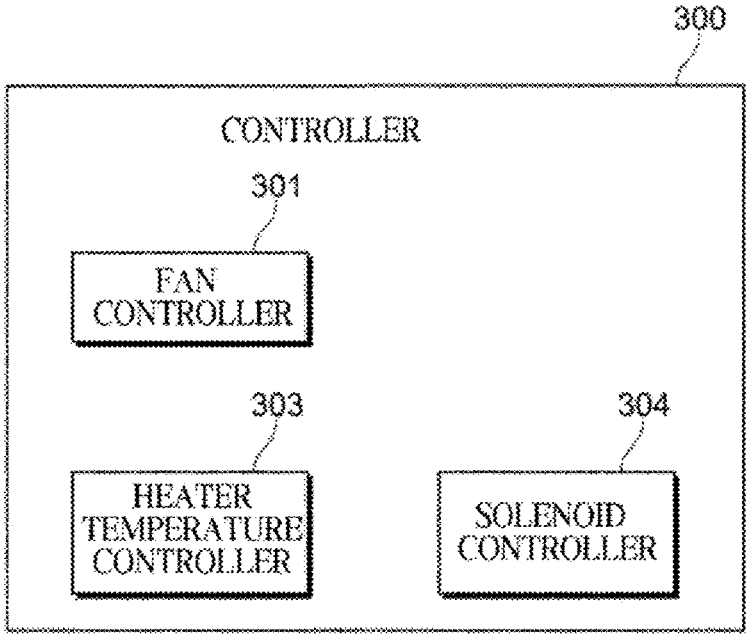
FIG. 7 illustrates a block diagram of a controller.

FIG. 7 illustrates a block diagram of the controller 300.

The controller 300 may include a fan controller 301 for controlling the rpm of a motor (not shown) for rotating the fan 310, a heater temperature controller 303 for controlling the temperature of the heater 360, and a solenoid controller 304 for controlling on/off of the solenoid 373.

The controller 300 may include at least one processor. The controller 300 may include a CPU (not shown) for arithmetic processing, ROM (not shown) for storing programs or various data that is executed by the CPU, and RAM (not shown) used as memory for tasks of the CPU. Also, the CPU may execute a program to implement the fan controller 301, the heater temperature controller 303, and the solenoid controller 304.

The fan controller 301 may convert the rpm of the fan 310 to two levels of high speed and low speed. However, the fan controller 301 may convert the rpm of the fan 310 to three or more levels or continuously. The fan controller 301 may convert the rpm of the fan 310 to high speed in the absorption mode, and in the regeneration mode, the fan controller 101 may convert the rpm of the fan 310 to low speed. That is, the fan controller 301 may be an example of a blow controller for controlling driving of the fan 310 in such a way to reduce an air volume when the heater 360 heats air rather than when the heater 360 does not heat air.

When the fan controller 301 converts the rpm of the fan 310 to low speed (in the regeneration mode), the heater temperature controller 303 may supply electricity to the heater 360 for a predetermined time period, thereby raising the temperature of the heater 360 to a predetermined temperature. Meanwhile, when the fan controller 301 converts the rpm of the fan 310 to high speed (in the absorption mode), the heater temperature controller 303 may supply no electricity to the heater 360.

When the fan controller 301 converts the rpm of the fan 310 to low speed (in the regeneration mode), the solenoid controller 304 may turn on the solenoid 373, and when the fan controller 301 converts the rpm of the fan 310 to high speed (in the absorption mode), the fan controller 301 may turn off the solenoid 373.

Figure 8:
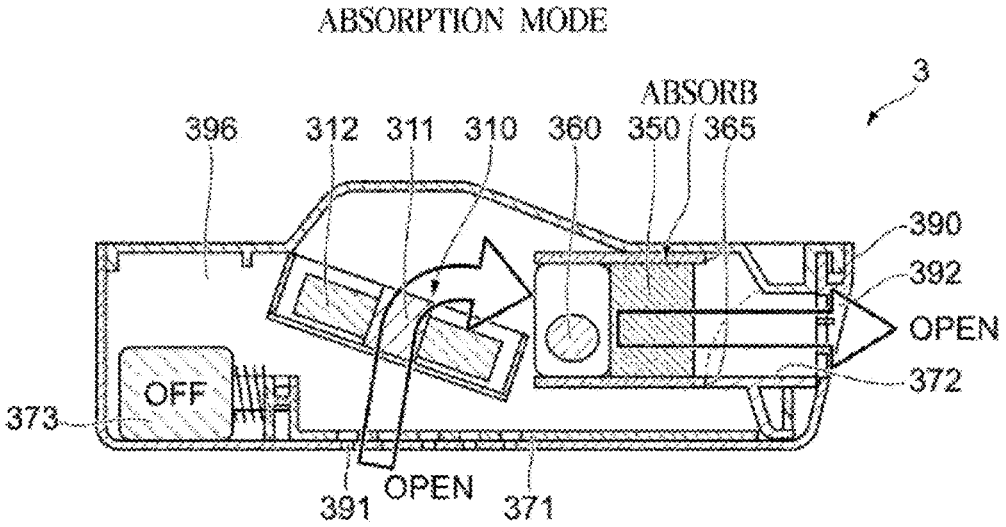
FIG. 8 illustrates a flow of air when the deodorizing apparatus is in an absorption mode.

FIG. 8 illustrates a flow of air when the deodorizing apparatus 3 is in the absorption mode.

Figure 9:
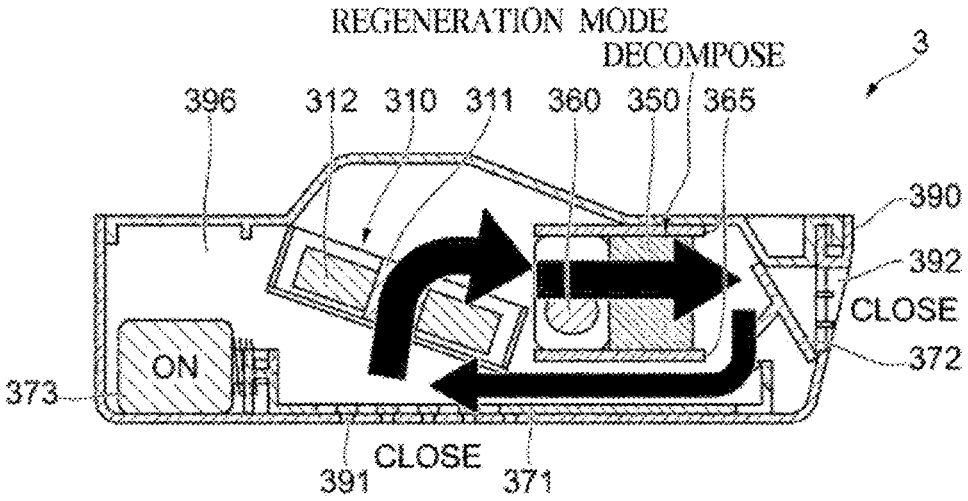
FIG. 9 illustrates a movement of heat when the deodorizing apparatus is in a regeneration mode.

FIG. 9 illustrates a movement of heat when the deodorizing apparatus 3 is in the regeneration mode.

When the deodorizing apparatus 3 according to an embodiment is in the absorption mode, the fan controller 301 may convert the rpm of the fan 310 to high speed, and the solenoid controller 304 may turn off the solenoid 373. Also, the heater temperature controller 303 may supply no electricity to the heater 360 so as not to raise the temperature of the heater 360. At this time, air inhaled into the inside of the case 390 by the fan 310 may pass through the accommodating room 396 to be discharged through the outlet 392. At this time, a malodorous substance included in the air may be absorbed in the catalyst 350.

Meanwhile, in the deodorizing apparatus 3, the fan controller 101 may convert the rpm of the fan 310 to low speed in the regeneration mode by taking into consideration that a decomposition rate of a malodorous substance by the catalyst 350 is slower than an absorption rate of the catalyst 350. The solenoid controller 304 may turn on the solenoid 373, and the heater temperature controller 303 may supply electricity to the heater 360 to raise the temperature of the heater 360. At this time, air inhaled in the inside of the case 390 by the fan 310 may flow toward the outlet 392 of the accommodating room 396. However, since the damper 372 closes the outlet 392, the air may pass through a lower portion of the accommodating room 396 to reach around the inlet 391. Also, since the shutter 371 closes the inlet 391, the air may be again inhaled into the inside of the case 390 by the fan 310 without being discharged through the inlet 391. Meanwhile, at this time, the passing speed of the air may be lower than the passing speed of air in the absorption mode.

Air got warm by the heater 360 may enter the catalyst 350. Therefore, the catalyst 350 may be heated and activated to decompose the malodorous substance absorbed therein.

Meanwhile, in an embodiment, the solenoid 373 may drive the shutter 371 and the damper 372 that are an opening/closing mechanism, although not limited thereto. As another example, the shutter 371 and the damper 372 may be driven by a motor, etc. Also, the shutter 371 may be opened and closed according to driving of the fan 310. Furthermore, the shutter 371 and the damper 372 may be opened and closed by using a material capable of being expanded or contracted by heat.

Also, in an embodiment, the heater 360 may be a non-contact type. That is, a configuration in which the heater 360 is disposed downstream from the fan 310 and upstream from the catalyst 350 on a blowing path may be adopted. The configuration may heat air on the blowing path, and raise the temperature of the front surface of the catalyst 350 uniformly to an activation temperature.

However, the heater 360 may be a contact type. That is, a configuration in which the heater 360 is in contact with the outer circumference of the catalyst 350 may be adopted. A first example of the configuration may be a configuration in which the catalyst 350 is surrounded with the heater 360 which is a code heater. A second example of the configuration may be a configuration in which the catalyst 350 is a heater-embedded catalyst in which the heater 360 is embedded. A third example of the configuration may be a configuration in which the heater 360 which is a rexam heater formed by connecting a plurality of surfaces to each other is in contact with the first surface or the second to fourth surfaces of the outer circumference of the catalyst 350. A fourth example of the configuration may be a configuration in which the heater 360 which is a rexam heater of a film type surrounds the outer circumference of the catalyst 350. A fifth example of the configuration may be a configuration in which the heater 360 which is a Positive Temperature Coefficient heater is in contact with the outer circumference of the catalyst 350.

Also, since the heater 360 is a non-contact type in an embodiment, the fan controller 301 may convert the rpm of the fan 310 to low speed when the deodorizing apparatus 3 is in the regeneration mode, although not limited thereto. When the heater 360 is a contact type, the fan controller 301 may stop rotating the fan 310 when the deodorizing apparatus 3 is in the regeneration mode. In this case, the fan controller 301 may be an example of a blow controller for controlling driving of the fan 310 such that the fan 310 stops when the heater 360 heats air.

Furthermore, in an embodiment, the metal component 365 may be installed around the heater 360 and the catalyst 350, although not limited thereto. As another example, an overheating preventing device, such as a temperature fuse or a temperature sensor, may be disposed around the heater 360.

As described above, since the deodorizing apparatus 3 according to an embodiment regenerates the catalyst 350, the deodorizing apparatus 3 may maintain the absorption capability (deodorizing capability) of the catalyst 350 for a long time, compared with a case in which a catalyst is not regenerated. Also, by using the catalyst 350 for regeneration and exposing a malodorous substance absorbed in the catalyst 350 to the catalyst 350, it may be possible to increase a decomposition rate. Also, by closing the opening/closing mechanism when raising the inside temperature of the case 390 to regenerate the catalyst 350, heat used for heating may be circulated. Also, since the case 390 is a double-layer structure having the air layer 399 in the inside, the inside of the case 390 may be insulated from the outside. Therefore, the deodorizing apparatus 3 may not discharge heat used for heating. As a result, the deodorizing apparatus 3 according to an embodiment may be used in an environment, such as the inside of the refrigerating room of a refrigerator, which needs to be maintained at a low temperature. Furthermore, although an odor is generated when a malodorous substance absorbed in the catalyst 350 is decomposed, the odor may be not discharged to the inside of the refrigerator since the opening/closing mechanism is closed.

Also, in an embodiment, the heater 360 may be any one of a non-contact type and a contact type. When a non-contact type, that is, the configuration in which the heater 360 is disposed downstream from the fan 310 and upstream from the catalyst 350 on the blowing path is adopted, heat may be applied to the front surface of the catalyst 350, and low-cost may be achieved. Meanwhile, when a contact type, that is, the configuration in which the heater 360 is in contact with the catalyst 350 is adopted, a simplified configuration may be implemented.

Furthermore, in an embodiment, the metal component 365 may be installed around the heater 360 to improve the heat transfer effect and safety. Accordingly, combustion may be prevented when an abnormal situation occurs.

Meanwhile, in the deodorizing apparatus 3 described above, a timing of conversion between the absorption mode and the regeneration mode so that the absorption mode and the regeneration mode are performed alternately may be not limited to a specific timing. For example, the deodorizing apparatus 3 may convert the absorption mode to the regeneration mode after the absorption mode is performed for a predetermined absorption mode period, and then convert the regeneration mode to the absorption mode after the regeneration mode is performed for a predetermined regeneration mode period. The predetermined absorption mode period may be equal to or different from the predetermined regeneration mode period.

Also, the deodorizing apparatus 3 may include an odor sensor (not shown) for detecting an odor. For example, the odor sensor may be disposed downstream from the catalyst 350, and when an amount of odor detected by the odor sensor is equal to or more than a predetermined amount, the deodorizing apparatus 1 may convert the absorption mode to the regeneration mode. In this case, the deodorizing apparatus 3 may perform the regeneration mode for the predetermined regeneration mode period, and then convert the regeneration mode to the absorption mode.

Since a refrigerator to which the deodorizing apparatus 3 according to an embodiment is applied is the same as the refrigerator to which the deodorizing apparatus 1 according to an embodiment shown in FIGS. 5A and 5B is applied, further descriptions thereof will be omitted. However, in the deodorizing apparatus 1 according to an embodiment, the inlet 91 of the case 90 may be disposed in the front portion of the case 90 and the outlet 92 of the case 90 may be disposed in the rear portion of the case 90, whereas in the deodorizing apparatus 3 according to an embodiment, the inlet 391 of the case 390 may be disposed in the lower portion of the case 390 and the outlet 392 of the case 390 may be disposed in the front portion of the case 390.

Figure 10A:
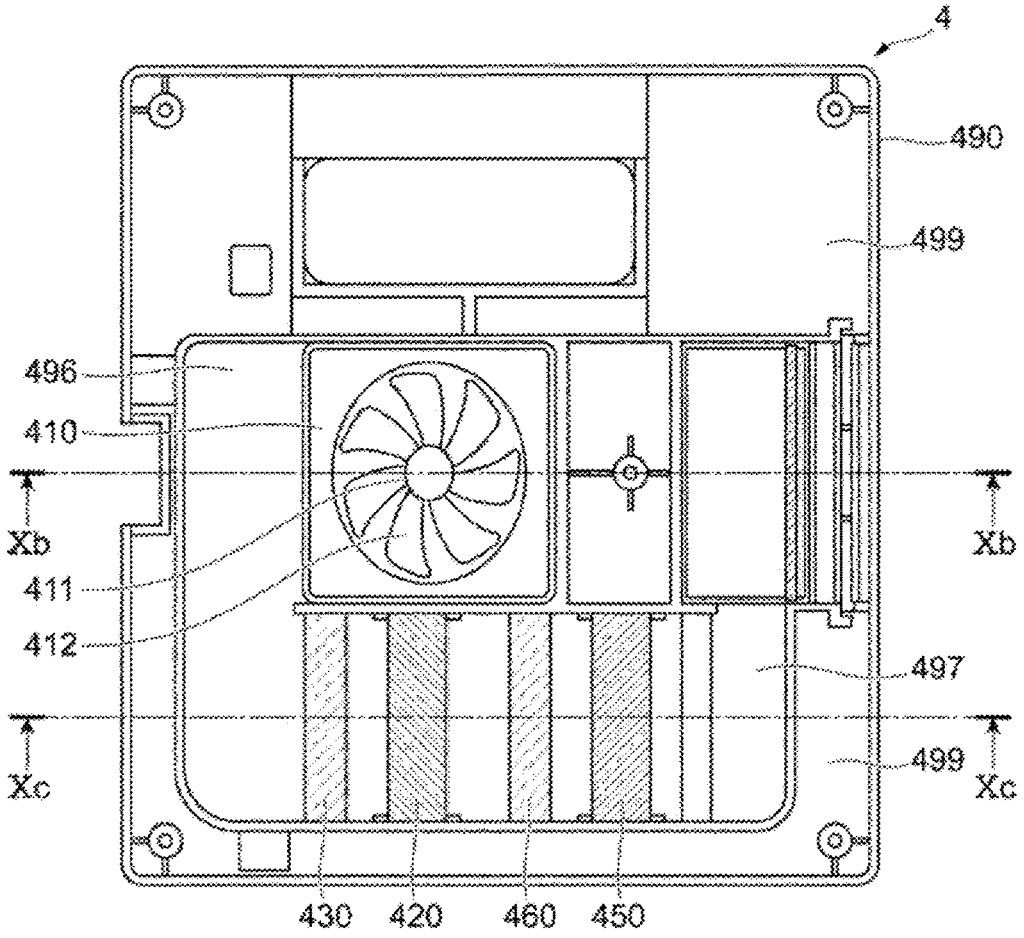
FIG. 10A illustrates a top view of a deodorizing apparatus according to an embodiment.
Figure 10B:
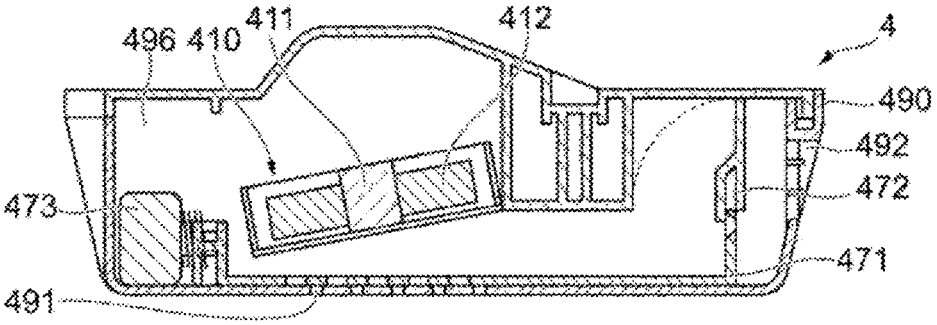
FIG. 10B is a schematic configuration view illustrating the inside of the deodorizing apparatus from a cross section of the deodorizing apparatus taken along line Xb-Xb of FIG. 10A.
Figure 10C:
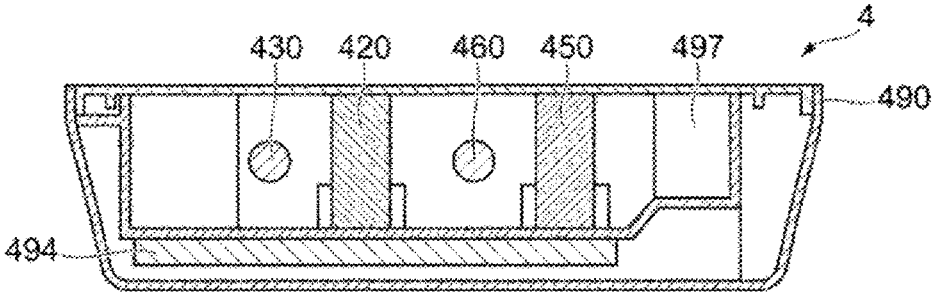
FIG. 10C is a schematic configuration view illustrating the inside of the deodorizing apparatus from a cross section of the deodorizing apparatus taken along line Xc-Xc of FIG. 10A.

FIG. 10A illustrates a top view of a deodorizing apparatus 4 according to an embodiment. The top view of FIG. 10A illustrates a part of an internal structure of the deodorizing apparatus 4. FIG. 10B is a schematic configuration view illustrating the inside of the deodorizing apparatus 4 from a cross section of the deodorizing apparatus 4 taken along line Xb-Xb of FIG. 10A, and FIG. 10C is a schematic configuration view illustrating the inside of the deodorizing apparatus 4 from a cross section of the deodorizing apparatus 4 taken along line Xc-Xc of FIG. 10A.

The deodorizing apparatus 4 according to an embodiment may include a fan 410 which is an example of a blower for generating a flow of air.

Also, the deodorizing apparatus 4 may include an absorbing material 420 disposed downstream from the fan 410 and being an example of an absorber that absorbs a malodorous substance from air passing therethrough and desorbs the malodorous substance by being heated, and a upstream heater 430 disposed downstream from the fan 410 and upstream from the absorbing material 420 and being an example of a upstream heating device that heats air entered the absorbing material 420.

Also, the deodorizing apparatus 4 may include a catalyst 450 which is an example of a decomposer for decomposing the malodorous substance desorbed by the absorbing material 420, and a downstream heater 460 disposed downstream from the absorbing material 420 and upstream from the catalyst 450 and being an example of a decomposing heater that heats air entering the catalyst 450.

Also, the deodorizing apparatus 4 may include a shutter 471 and a damper 472 which are an opening/closing mechanism as an example of a suppressor for preventing air passed through the catalyst 450 from being discharged to the outside, a solenoid 473 for performing opening and closing operations of the shutter 471 and the damper 472, and an insulator 494 for preventing heat from the upstream heater 430 and the downstream heater 460 from being transferred to the outside.

Also, the deodorizing apparatus 4 may include a case 490 formed in the shape of a rectangular parallelepiped for accommodating the fan 410, the absorbing material 420, the upstream heater 430, the catalyst 450, the downstream heater 460, the shutter 471, the damper 472, the solenoid 473, and the insulator 494, wherein an inlet 491 through which air enters and an outlet 492 through which air exits may be formed in the case 490.

Also, the deodorizing apparatus 4 may include a controller 400 including at least one processor for controlling driving of the fan 410, operations of the upstream heater 430, operations of the downstream heater 460, and driving of the solenoid 473, etc.

The deodorizing apparatus 4 according to an embodiment may be an apparatus capable of switching between an absorption mode for absorbing a malodorous substance existing in air through the absorbing material 420 and a regeneration mode for desorbing the malodorous substance from the absorbing material 420 to regenerate the absorbing material 20 and decomposing the desorbed malodorous substance through the catalyst 450. Also, the deodorizing apparatus 4 may perform the absorption mode and the regeneration mode alternately, and maintain high deodorization capability of the absorbing material 20 for a long time.

Hereinafter, the components included in the deodorizing apparatus 4 will be described in detail.

The fan 410 may include a rotation shaft 411, a plurality of blades 412 arranged around the rotation shaft 411, and a motor (not shown) for rotating the rotation shaft 411. In the fan 410 according to an embodiment, the rotation shaft 411 may be disposed in the front-rear direction in such a way to be a little tilted downward in a left direction, as seen in FIG. 10A, and as seen in FIG. 10B, the rotation shaft 411 may be disposed in an up-down direction in such a way to be a little tilted downward in the left direction. Also, the fan 410 may introduce outside air to the inside of the case 490 through the inlet 491, and cause the inside air to enter the absorbing material 420. The rpm of the motor may be controlled by the controller 400.

The absorbing material 420 may have activated carbon for absorbing a malodorous substance existing in air passing therethrough to perform deodorization, and desorbing the malodorous substance by being heated.

The upstream heater 430 may be disposed downstream from the fan 410 and upstream from the absorbing material 420. When electricity is supplied to the upstream heater 430 for a predetermined time, the upstream heater 430 may raise the temperature of the absorbing material 420 or air entered the absorbing material 420 to a predetermined temperature at which a malodorous substance absorbed in the absorbing material 420 may be removed. The supply of electricity to the upstream heater 430 may be controlled by the controller 400. Meanwhile, the upstream heater 430 may be a dedicated heater that operates by power supplied from the main body of the refrigerator, not a defrosting heater included in the main body of the refrigerator, to prevent the deodorizing apparatus 4 from interfering with a refrigerating cycle.

The catalyst 450 may be a catalyst-supported filter in which an oxidation catalyst is supported on both sides of a substrate having high heat conductivity. The oxidation catalyst may be one or more kinds of metals selected from among Ag, Pd, Pt, Mn, Rh, Fe, Co, I, P, Ti, and K, or metal oxide thereof. The oxidation catalyst may remove or reduce a malodorous component of by-products that may be generated in a process of decomposing a malodorous component absorbed in the catalyst-supported filter. For example, methyl disulfide $(CH_3)_2S_2$ that may be generated in a process of decomposing methyl mercaptan $CH_3SH$ has a low odor compared with the methyl mercaptan $CH_3SH$. The catalyst 350 may be a photocatalyst.

The downstream heater 460 may be disposed downstream from the absorbing material 420 and upstream from the catalyst 450. When electricity is supplied to the downstream heater 460 for a predetermined time, the downstream heater 460 may raise the temperature of the catalyst 450 or air entered the catalyst 450 to a predetermined temperature at which a malodorous substance desorbed from the absorbing material 420 may be decomposed. The supply of electricity to the downstream heater 460 may be controlled by the controller 400. Meanwhile, the downstream heater 460 may be a dedicated heater that operates by power supplied from the main body of the refrigerator, not a defrosting heater included in the main body of the refrigerator, to prevent the deodorizing apparatus 4 from interfering with a refrigerating cycle. Also, the temperature of the downstream heater 460 for activating the catalyst 450 may be 100° C. or lower. That is, the downstream heater 460 may use a temperature that can be applied to home appliances (particularly, refrigerators). Although the catalyst 450 has decomposition capability even under a low temperature condition, the decomposition capability of the catalyst 450 may be improved when the catalyst 450 is activated under the condition of high-temperature (equal to or lower than 100° C.) heating.

The shutter 471 may be disposed along the bottom of the case 490. The shutter 471 may have a hole having the same size as the inlet 491 formed in the bottom of the case 490 and disposed to correspond to the inlet 491. The shutter 471 may slide along the bottom of the case 490.

The damper 472 may be disposed around the outlet 492 in the inside of the case 490. The damper 472 may rotate when the shutter 471 slides along the bottom of the case 490.

That is, the shutter 471 and the damper 472 may be an example of an opening/closing member for opening and closing the inlet 491 and the outlet 492.

The solenoid 473 may be disposed at a location at which it does not interfere with a flow of air in the inside of the case 490. When the solenoid 473 is in an on state, the solenoid 473 may cause the shutter 471 to slide along the bottom of the case 490 to close the inlet 491 to prevent air from entering the case 490, and also rotate the damper 472 to close the outlet 492 to prevent air from being discharged to the outside. That is, the solenoid 473 may be an example of an opening/closing control member for controlling the shutter 471 and the damper 472 to close the inlet 491 and the outlet 492 when the upstream heater 430 and the downstream heater 460 heat air. The solenoid 473 may be turned on/off by the controller 400. Meanwhile, the drawings show a state in which when the solenoid 473 is in the on state, the inlet 491 and the outlet 492 are closed.

The insulator 494 may prevent heat from the upstream heater 430 and the downstream heater 460 from being transferred to the outside of the deodorizing apparatus 4 to insulate the inside of the case 490 from the outside of the case 490.

The case 490 may include a first accommodating room 496 of the center portion where the inlet 491 and the outlet 492 are formed, and a second accommodating room 497 formed in one side of the first accommodating room 496.

In the first accommodating room 496 and the second accommodating room 497, the shutter 471, the fan 410, the upstream heater 430, the absorbing material 420, the downstream heater 460, the catalyst 450, and the damper 472 may be disposed in this order from the inlet 491.

According to the above-described arrangement, air entered the inside of the case 490 through the inlet 391 by the fan 310 may pass through the upstream heater 430, the absorbing material 420, the downstream heater 460, and the catalyst 450 in this order to be discharged to the outside of the case 490 through the outlet 492 or to circulate in the inside of the case 490.

The case 490 may be a double-layer structure having an air layer 499 formed in one side of the first accommodating room 496, which is opposite to the second accommodating room 497, and in one side of the second accommodating room 497, which is opposite to the first accommodating room 496. Therefore, the inside of the case 490 may be insulated from the outside.

Figure 11:
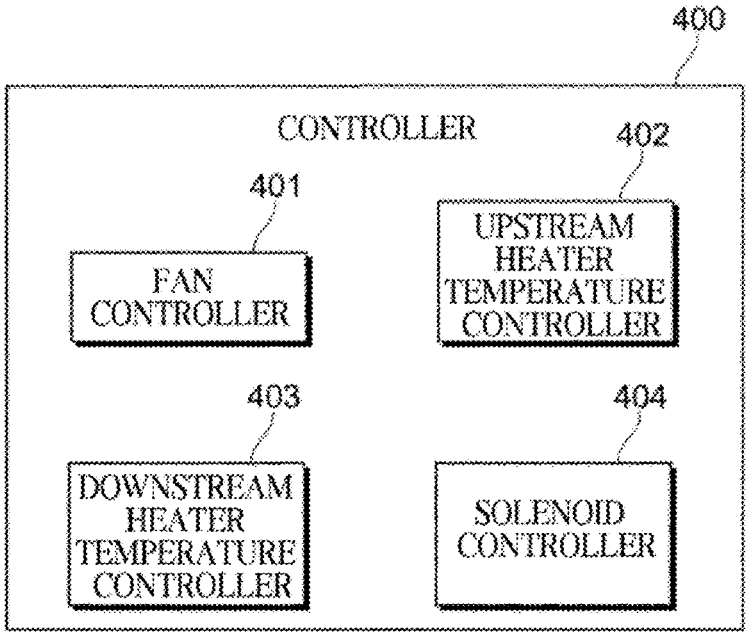
FIG. 11 illustrates a block diagram of a controller.

FIG. 11 illustrates a block diagram of the controller 400.

The controller 400 may include a fan controller 401 for controlling the rpm of a motor (not shown) for rotating the fan 410, a upstream heater temperature controller 402 for controlling a temperature of the upstream heater 430, a downstream heater temperature controller 403 for controlling a temperature of the downstream heater 460, and a solenoid controller 404 for controlling on/off of the solenoid 473.

The controller 400 may include at least one processor. The controller 400 may include a CPU (not shown) for arithmetic processing, ROM (not shown) for storing programs or various data that is executed by the CPU, and RAM (not shown) used as memory for tasks of the CPU. Also, the CPU may execute a program to implement the fan controller 401, the upstream heater temperature controller 402, the downstream heater temperature controller 403, and the solenoid controller 404.

The fan controller 401 may convert the rpm of the fan 410 to two levels of high speed and low speed. However, the fan controller 401 may convert the rpm of the fan 410 to three or more levels or continuously. The fan controller 401 may convert the rpm of the fan 410 to high speed in the absorption mode, and in the regeneration mode, the fan controller 401 may convert the rpm of the fan 410 to low speed. That is, the fan controller 401 may be an example of a blow controller for controlling driving of the fan 410 in such a way to reduce an air volume when the upstream heater 430 and the downstream heater 460 heat air rather than when the upstream heater 430 and the downstream heater 460 do not heat air.

When the fan controller 401 converts the rpm of the fan 410 to low speed (in the regeneration mode), the upstream heater temperature controller 402 may supply electricity to the upstream heater 430 for a predetermined time to raise the temperature of the upstream heater 430 to a predetermined temperature. Meanwhile, when the fan controller 401 converts the rpm of the fan 410 to high speed (in the absorption mode), the upstream heater temperature controller 402 may supply no electricity to the upstream heater 430.

When the fan controller 401 converts the rpm of the fan 410 to low speed (in the regeneration mode), the downstream heater temperature controller 403 may supply electricity to the downstream heater 460 for a predetermined time period, thereby raising the temperature of the downstream heater 460 to a predetermined temperature. Meanwhile, when the fan controller 401 converts the rpm of the fan 410 to high speed (in the absorption mode), the downstream heater temperature controller 403 may supply no electricity to the downstream heater 460.

When the fan controller 401 converts the rpm of the fan 410 to low speed (in the regeneration mode), the solenoid controller 404 may turn on the solenoid 473, and when the fan controller 401 converts the rpm of the fan 410 to high speed (in the absorption mode), the solenoid controller 404 may turn off the solenoid 473.

Figure 12A:
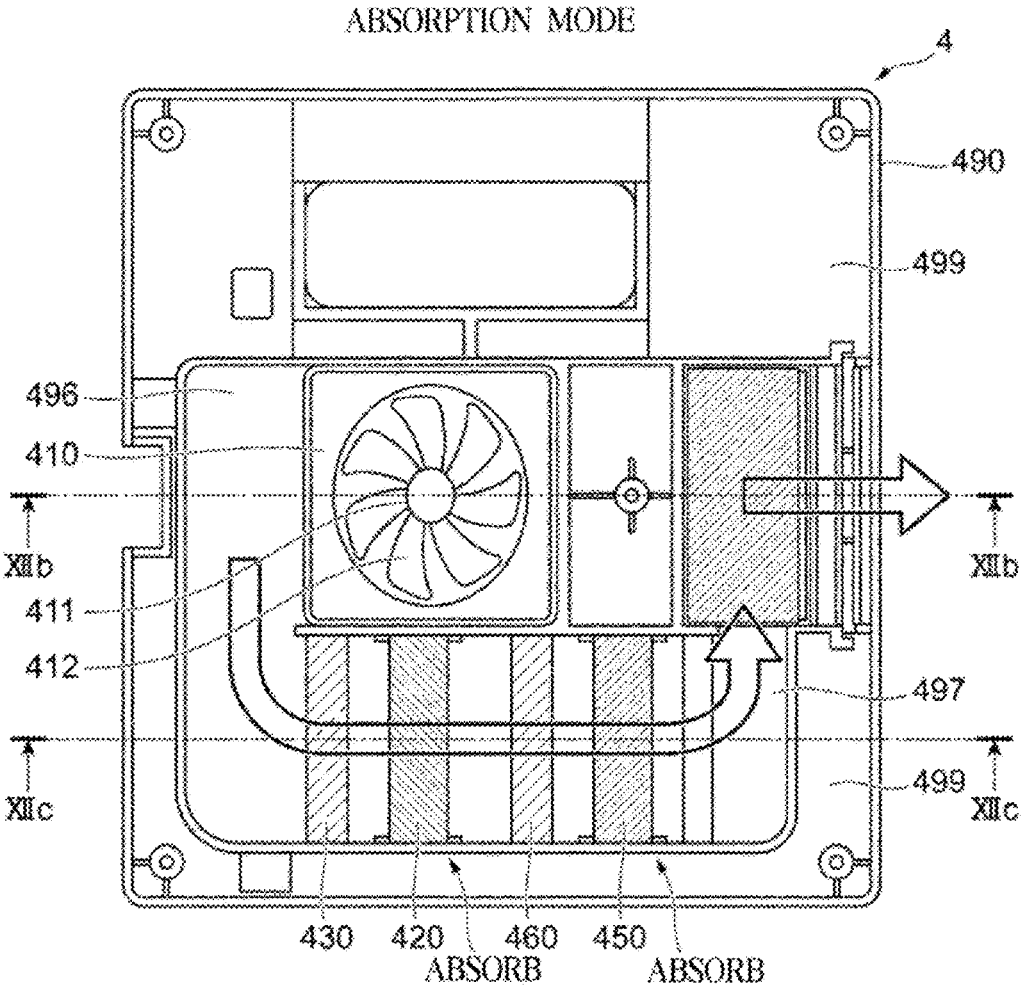
FIGS. 12A-12C illustrate a flow of air when the deodorizing apparatus is in an absorption mode.
Figure 12B:
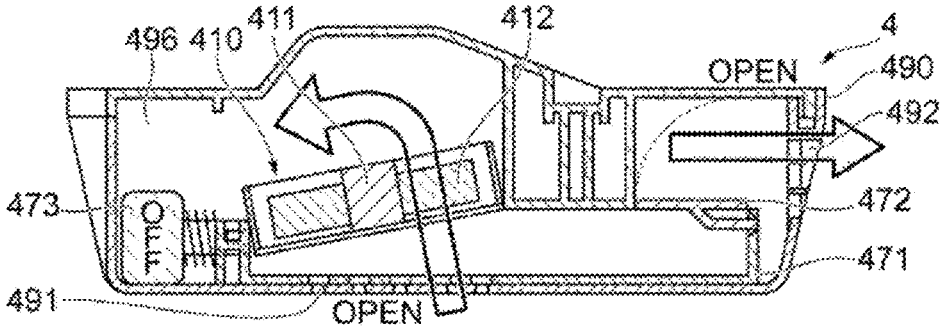
Figure 12C:
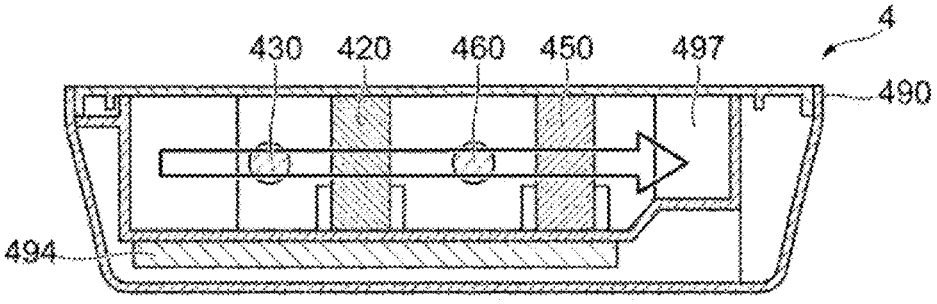

FIGS. 12A to 12C illustrate a flow of air when the deodorizing apparatus 4 is in the absorption mode.

Figure 13A:
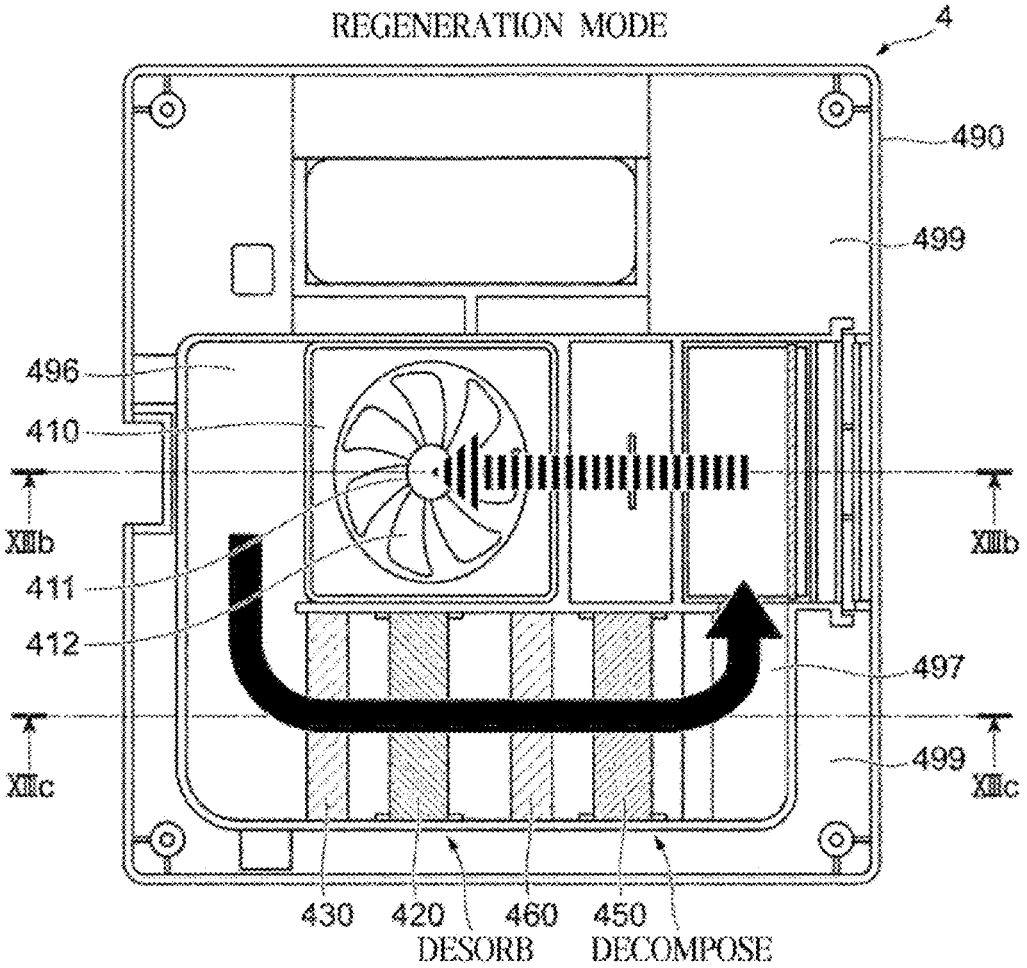
FIGS. 13A-13C illustrate a flow of heat when the deodorizing apparatus is in a regeneration mode.
Figure 13B:
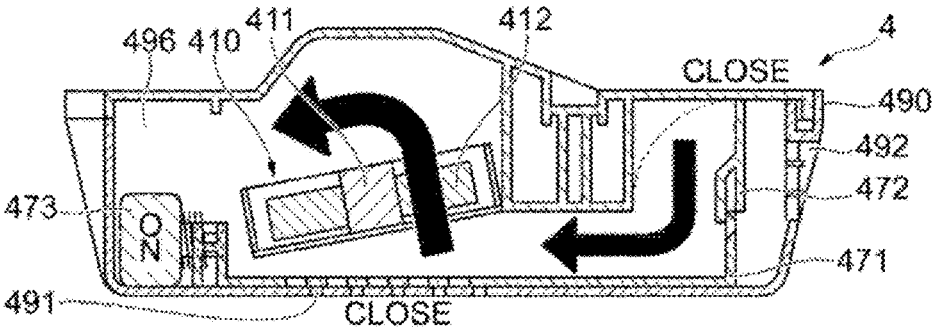
Figure 13C:
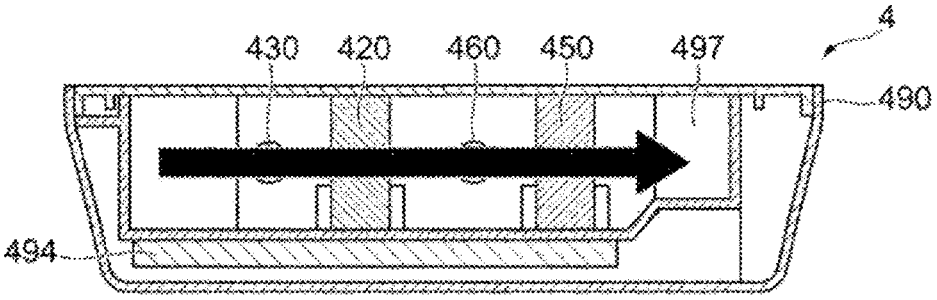

FIGS. 13A to 13C illustrate a flow of heat when the deodorizing apparatus 4 is in the regeneration mode.

When the deodorizing apparatus 4 according to an embodiment is in the absorption mode, the fan controller 401 may convert the rpm of the fan 410 to high speed, and the solenoid controller 404 may turn off the solenoid 473. Also, the upstream heater temperature controller 402 and the downstream heater temperature controller 403 may supply no electricity to the upstream heater 430 and the downstream heater 460 so as not to raise the temperature of the upstream heater 430 and the downstream heater 460. At this time, air inhaled into the inside of the case 490 by the fan 410 may pass through the first accommodating room 496 and the second accommodating room 497, and then return to the first accommodating room 496 to be discharged through the outlet 492. At this time, a malodorous substance included in the air may be absorbed in the absorbing material 420. Also, when the catalyst 450 is a catalyst-supported filter, the malodorous substance included in the air may also be absorbed in the catalyst 450.

Meanwhile, in the deodorizing apparatus 4, the fan controller 401 may convert the rpm of the fan 410 to low speed in the regeneration mode by taking into consideration that a decomposition rate of a malodorous substance by the catalyst 450 is slower than an absorption rate of the absorbing material 420. The solenoid controller 404 may turn on the solenoid 473, and the upstream heater temperature controller 402 and the downstream heater temperature controller 403 may supply electricity to the upstream heater 430 and the downstream heater 460, respectively, to raise the temperature of the upstream heater 430 and the downstream heater 460. At this time, likewise, air inhaled into the inside of the case 490 by the fan 410 may pass through the first accommodating room 496 and the second accommodating room 497, and then return to the first accommodating room 496. However, since the damper 472 closes the outlet 492, the air may pass through the lower area of the first accommodating room 496 to reach around the inlet 491. Meanwhile, the passing speed of the air may be lower than the passing speed of air in the absorption mode.

The absorbing material 420 may get warm by the upstream heater 430 and the downstream heater 460, and also air heated by the upstream heater 430 may enter the absorbing material 420. Therefore, the absorbing material 420 may be heated to desorb the malodorous substance absorbed therein. Accordingly, the absorbing material 420 may be regenerated.

The catalyst 450 may get warm by the downstream heater 460, and air heated by the upstream heater 430, passed through the absorbing material 420, and then got warm by the downstream heater 460 may enter the catalyst 450. Therefore, the catalyst 450 may be heated and activated to decompose the malodorous substance desorbed from the absorbing material 420. Also, when the catalyst 450 is a catalyst-supported filter, the catalyst 450 may decompose the malodorous sub stance absorbed therein.

Meanwhile, in an embodiment, the solenoid 473 may drive the shutter 471 and the damper 472 that are an opening/closing mechanism, although not limited thereto. As another example, the shutter 471 and the damper 472 may be driven by a motor, etc. Also, the shutter 471 may be opened and closed according to driving of the fan 410. Furthermore, the shutter 471 and the damper 472 may be opened and closed by using a material capable of being expanded or contracted by heat.

Also, in an embodiment, the upstream heater 430 and the downstream heater 460 may be a non-contact type. That is, a configuration in which the upstream heater 430 is disposed downstream from the fan 410 and upstream from the absorbing material 420 on a blowing path, and the downstream heater 460 is disposed downstream from the absorbing material 420 and upstream from the catalyst 450 on the blowing path may be adopted. The configuration may heat air on the blowing path, and raise the temperature of the front surfaces of the absorbing material 420 and the catalyst 450 uniformly to an activation temperature.

However, the upstream heater 430 and the downstream heater 460 may be a contact type. That is, a configuration in which the upstream heater 430 is in contact with the outer circumference of the absorbing material 420, or a configuration in which the downstream heater 460 is in contact with the outer circumference of the catalyst 450 may be adopted. Examples of the configurations have been described in detail in an embodiment, and accordingly, further descriptions thereof will be omitted.

Also, in an embodiment, since the upstream heater 430 and the downstream heater 460 are a non-contact type, the fan controller 401 may convert the rpm of the fan 410 to low speed when the deodorizing apparatus 4 is in the regeneration mode, although not limited thereto. In the case in which the upstream heater 430 and the downstream heater 460 are a contact type, the fan controller 401 may stop rotating the fan 410 when the deodorizing apparatus 4 is in the regeneration mode. In this case, the fan controller 401 may be an example of a blow controller for controlling driving of the fan 410 such that the fan 410 stops when the upstream heater 430 and the downstream heater 460 heat air.

Furthermore, in an embodiment, likewise, a metal component may be installed around the upstream heater 430 and the absorbing material 420 and around the downstream heater 460 and the catalyst 450, although not limited thereto. As another example, an over-heating preventing device, such as a temperature fuse or a temperature sensor, may be disposed around the upstream heater 430 and the absorbing material 420 and around the downstream heater 460 and the catalyst 450.

As described above, since the deodorizing apparatus 4 according to an embodiment performs deodorization by the absorbing material 420, the deodorizing apparatus 4 may achieve high absorption speed, while saving energy. Also, since the deodorizing apparatus 4 according to an embodiment regenerates the absorbing material 420, the deodorizing apparatus 4 may maintain the absorption capability (deodorizing capability) of the absorbing material 420 for a long time, compared with a case in which an absorbing material is not regenerated. Also, by using the catalyst 450 for regeneration and exposing a malodorous substance absorbed in the absorbing material 420 to the catalyst 450, it may be possible to increase decomposition speed. Also, by closing the opening/closing mechanism when raising the inside temperature of the case 490 to regenerate the absorbing material 420, heat used for heating may be circulated. Also, since the case 490 is a double-layer structure having the air layer 499 in the inside, the inside of the case 490 may be insulated from the outside. Therefore, the deodorizing apparatus 4 may not discharge heat used for heating. As a result, the deodorizing apparatus 4 according to an embodiment may be used in an environment, such as the inside of the refrigerating room of a refrigerator, which needs to be maintained at a low temperature. Furthermore, although an odor is generated when a malodorous substance absorbed in the absorbing material 420 is decomposed, the odor may be not discharged to the inside of the refrigerator since the opening/closing mechanism is closed.

Also, in an embodiment, the upstream heater 430 and the downstream heater 460 may be any one of a non-contact type and a contact type. When a non-contact type, that is, the configuration in which the upstream heater 430 is disposed downstream from the fan 410 and upstream from the absorbing material 420 on the blowing path and the downstream heater 460 is disposed downstream from the absorbing material 420 and upstream from the absorbing material 420 on the blowing path is disposed is adopted, heat may be applied to the front surfaces of the absorbing material 420 and the catalyst 450, and low-cost may be achieved. Meanwhile, when a contact type, that is, the configuration in which the upstream heater 430 is in contact with the absorbing material 420 and the downstream heater 460 is in contact with the catalyst 450 is adopted, a simplified configuration may be implemented.

Furthermore, in an embodiment, a metal component may be installed around the upstream heater 430 and the downstream heater 460 to improve the heat transfer effect and safety. Accordingly, by installing the metal component, combustion may be prevented when an abnormal situation occurs.

Meanwhile, in the deodorizing apparatus 4 described above, a timing of conversion between the absorption mode and the regeneration mode so that the absorption mode and the regeneration mode are performed alternately may be not limited to a specific timing. For example, the deodorizing apparatus 4 may convert the absorption mode to the regeneration mode after the absorption mode is performed for a predetermined absorption mode period, and then convert the regeneration mode to the absorption mode after the regeneration mode is performed for a predetermined regeneration mode period. The predetermined absorption mode period may be equal to or different from the predetermined regeneration mode period.

Also, the deodorizing apparatus 4 may include an odor sensor (not shown) for detecting an odor. For example, the odor sensor may be disposed downstream from the absorbing material 420, and when an amount of odor detected by the odor sensor is equal to or more than a predetermined amount, the deodorizing apparatus 4 may convert the absorption mode to the regeneration mode. In this case, the deodorizing apparatus 4 may perform the regeneration mode for the predetermined regeneration mode period, and then convert the regeneration mode to the absorption mode.

Since a refrigerator to which the deodorizing apparatus 4 according to an embodiment is applied is the same as the refrigerator to which the deodorizing apparatus 1 according to an embodiment shown in FIGS. 5A and 5B is applied, further descriptions thereof will be omitted. However, in the deodorizing apparatus 1 according to an embodiment, the inlet 91 of the case 90 may be disposed in the front portion of the case 90, and the outlet 92 of the case 90 may be disposed in the rear portion of the case 90, whereas in the deodorizing apparatus 4 according to an embodiment, the inlet 491 of the case 490 may be disposed in the lower portion of the case 490, and the outlet 492 of the case 490 may be disposed in the front portion of the case 490.

Figure 14A:
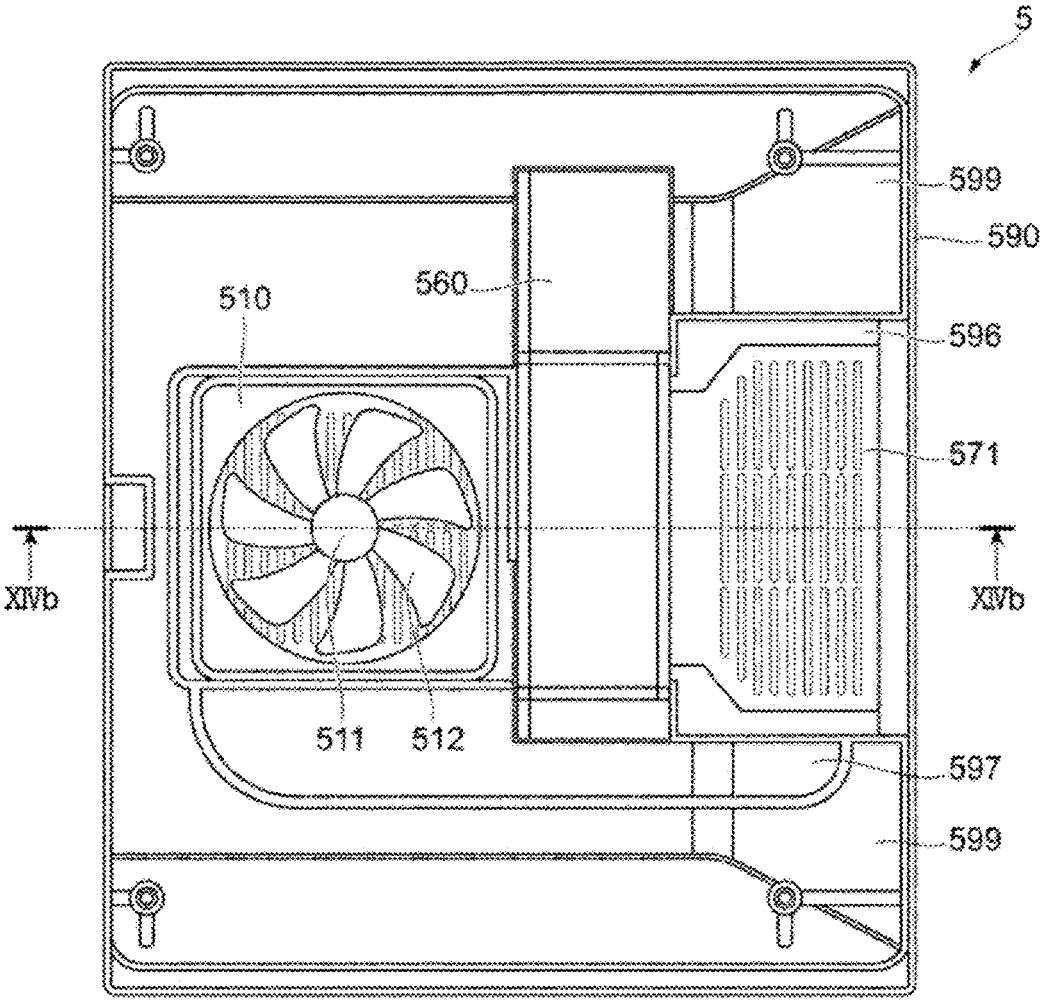
FIG. 14A illustrates a top view of a deodorizing apparatus according to an embodiment.
Figure 14B:
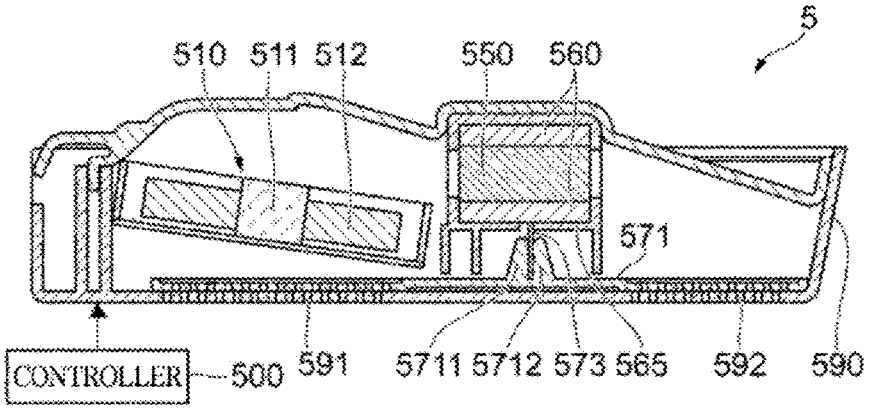
FIG. 14B is a schematic configuration view illustrating the inside of the deodorizing apparatus from a cross section of the deodorizing apparatus taken along line XIVb-XIVb of FIG. 14A.

FIG. 14A illustrates a top view of a deodorizing apparatus 5 according to an embodiment. The top view of FIG. 14A illustrates a part of an internal structure of the deodorizing apparatus 5. FIG. 14B is a schematic configuration view illustrating the inside of the deodorizing apparatus 5 from a cross section of the deodorizing apparatus 5 taken along line XIVb-XIVb of FIG. 14A.

The deodorizing apparatus 5 according to an embodiment may include a fan 510 which is an example of a blower for generating a flow of air.

Also, the deodorizing apparatus 5 may include a catalyst 550 disposed downstream from the fan 510 and being an example of an absorptive decomposer for absorbing a malodorous substance from air passing therethrough and decomposing the malodorous substance by being heated, and a heater 560 disposed downstream from the fan 510 and being an example of a heating device for heating the catalyst 550.

Also, the deodorizing apparatus 5 may be a shutter 571 which is an opening/closing mechanism as an example of a suppressor for preventing air passed through the catalyst 550 from being discharged to the outside, a bimetal plate 573 for opening and closing the shutter 571, and a metal component 565 which is an example of a component for transferring heat from the heater 560 to the bimetal plate 573.

Also, the deodorizing apparatus 5 may include a case 590 formed in the shape of a rectangular parallelepiped for accommodating the fan 510, the catalyst 550, the heater 560, the metal component 565, the shutter 571, and the bimetal plate 573, wherein an inlet 491 through which air enters and an outlet 492 through which air exits may be formed in the case 590.

Also, the deodorizing apparatus 5 may include a controller 500 including at least one processor for controlling driving of the fan 510, operations of the heater 560, etc.

The deodorizing apparatus 5 according to an embodiment may be an apparatus capable of switching between an absorption mode for absorbing a malodorous substance existing in air through the catalyst 550 and a regeneration mode for desorbing the absorbed malodorous substance through the catalyst 550 to regenerate the catalyst 550. Also, the deodorizing apparatus 5 may perform the absorption mode and the regeneration mode alternately, and maintain high deodorizing capability of the catalyst 550 for a long time.

Hereinafter, the components included in the deodorizing apparatus 5 will be described in detail.

The fan 510 may include a rotation shaft 511, a plurality of blades 512 arranged around the rotation shaft 511, and a motor (not shown) for rotating the rotation shaft 511. In the fan 510 according to an embodiment, the rotation shaft 511 may be disposed in the front-rear direction in such a way to be a little tilted downward in the left direction, as seen in FIG. 14A, and as seen in FIG. 14B, the rotation shaft 511 may be disposed in the up-down direction in such a way to be a little tilted downward in the left direction. Also, the fan 510 may introduce outside air to the inside of the case 590 through the inlet 591, and also cause the air to flow to the catalyst 550. The rpm of the motor may be controlled by the controller 500.

The catalyst 550 may be a porous structure having a gas absorption function, and may be a catalyst-supported filter in which an oxidation catalyst is supported on both sides of a substrate having high heat conductivity. The oxidation catalyst may be one or more materials selected from among Ag, Pd, Pt, Mn, Rh, Fe, Co, I, P, Ti, and K, or oxides of the materials. The oxidation catalyst may remove or reduce a malodorous component of by-products that may be generated in a process of decomposing a malodorous component absorbed in the catalyst-supported filter. For example, methyl disulfide $(CH_3)_2S_2$ that may be generated in a process of decomposing methyl mercaptan $CH_3SH$ has a low odor compared with the methyl mercaptan $CH_3SH$. The catalyst 550 may be a photocatalyst.

The heater 560 may be disposed downstream from the fan 510. When electricity is supplied to the heater 560 for a predetermined time, the heater 560 may raise the temperature of air entered the catalyst 550 to a predetermined temperature at which a malodorous substance absorbed in the catalyst 550 may be decomposed. The supply of electricity to the heater 560 may be controlled by the controller 500. Meanwhile, the heater 560 may be a dedicated heater that operates by power supplied from the main body of the refrigerator, not a defrosting heater included in the main body of the refrigerator, to prevent the deodorizing apparatus 5 from interfering with a refrigerating cycle. Also, the temperature of the heater 560 for activating the catalyst 550 may be 100° C. or lower. That is, the heater 560 may use a temperature that can be applied to home appliances (particularly, refrigerators). Although the catalyst 550 has decomposition capability even under a low temperature condition, the decomposition capability of the catalyst 550 may be improved when the catalyst 550 is activated under the condition of high-temperature (equal to or lower than 100° C.) heating.

The metal component 565 may be installed between the heater 560 and the bimetal plate 573 to improve the heat transfer effect. The metal component 565 may use, for example, SUS. Meanwhile, since the bimetal plate 573 is fixed at one end, which will be described later with reference to FIGS. 15A and 15B, the metal component 565 may connect the heater 560 to the fixed end of the bimetal plate 573.

The shutter 571 may be disposed along the bottom of the case 590. The shutter 571 may have a hole having the same size as the inlet 591 and the outlet 592 formed in the bottom of the case 590 and disposed to correspond to the inlet 591 and the outlet 592. The shutter 571 may slide along the bottom of the case 590. That is, the shutter 571 may be an example of an opening/closing member for opening and closing the inlet 591 and the outlet 592. Meanwhile, in an embodiment, the opening/closing member may be configured with one component (that is, the shutter 571).

The bimetal plate 573 may be disposed at a position to which heat from the heater 560 in the case 590 is transferred. The bimetal plate 573 may be a metal plate manufactured by coupling two kinds of metals having different thermal expansion rates with each other. The two kinds of metals having different thermal expansion rates may use a Fe—Ni—Cr alloy as a metal having a relatively high thermal expansion rate, and a Fe—Ni alloy having a Ni content of about 36% as a metal having a relatively low thermal expansion rate. When heat from the heater 560 is transferred to the bimetal plate 573, the bimetal plate 573 may cause the shutter 571 to slide along the bottom of the case 590 through a first protrusion 5711 and a second protrusion 5712 to close the inlet 591 and the outlet 592, thereby preventing air from entering and being discharged. That is, the bimetal plate 593 may be an example of an opening/closing control member for controlling the shutter 571 to close the inlet 591 and the outlet 592 when the heater 560 heats the catalyst 550. Meanwhile, the drawings show a state in which the inlet 591 and the outlet 592 are closed when heat from the heater 560 is transferred to the bimetal plate 573.

The case 590 may have a first accommodating room 596 and a second accommodating room 597 formed in one side of the first accommodating room 596, wherein the inlet 591 and the outlet 592 may be formed in the center portion of the first accommodating room 596.

In the first accommodating room 596, the shutter 571, the fan 510, and the catalyst 550 which the heater 560 is in contact with may be disposed in this order from the inlet 591. The shutter 571 may also be disposed in the outlet 592. When the outlet 592 is closed, the second accommodating room 597 may be formed as a passage through which air returns to the fan 510.

According to the above-described arrangement, air entered the inside of the case 590 through the inlet 591 by the fan 510 may pass through the catalyst 550 which the heater 560 is in contact with to be discharged to the outside of the case 590 through the outlet 592 or to circulate in the inside of the case 590.

The case 590 may be a double-layer structure having an air layer 599 formed in one side of the first accommodating room 596, which is opposite to the second accommodating room 597, and in one side of the second accommodating room 597, which is opposite to the first accommodating room 596. Therefore, the inside of the case 590 may be insulated from the outside.

Hereinafter, operation of controlling sliding of the shutter 571 by the bimetal plate 573 will be described in more detail.

Figure 15A:
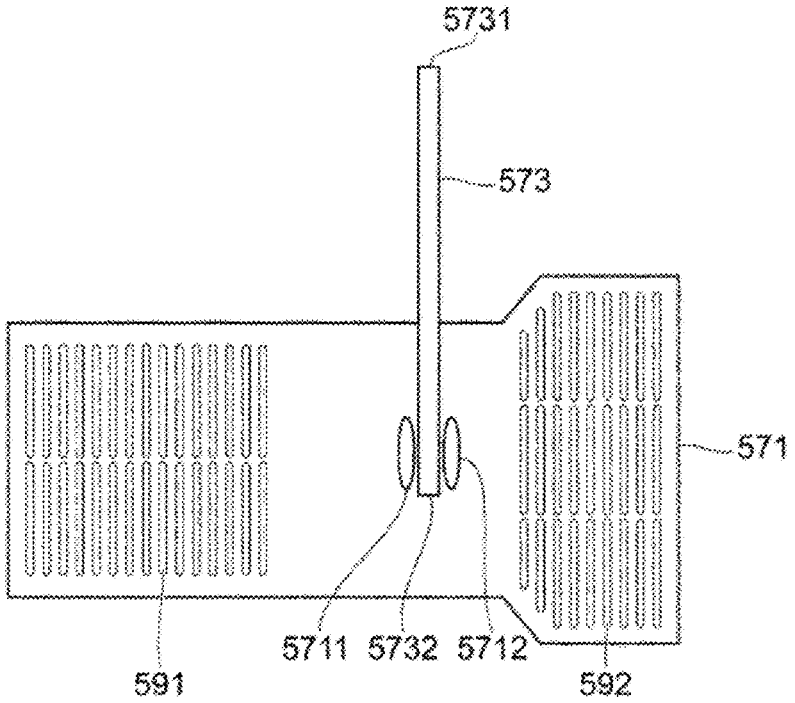
FIG. 15A illustrates a state of a bimetal plate when heat from a heater is not transferred to the bimetal plate.
Figure 15B:
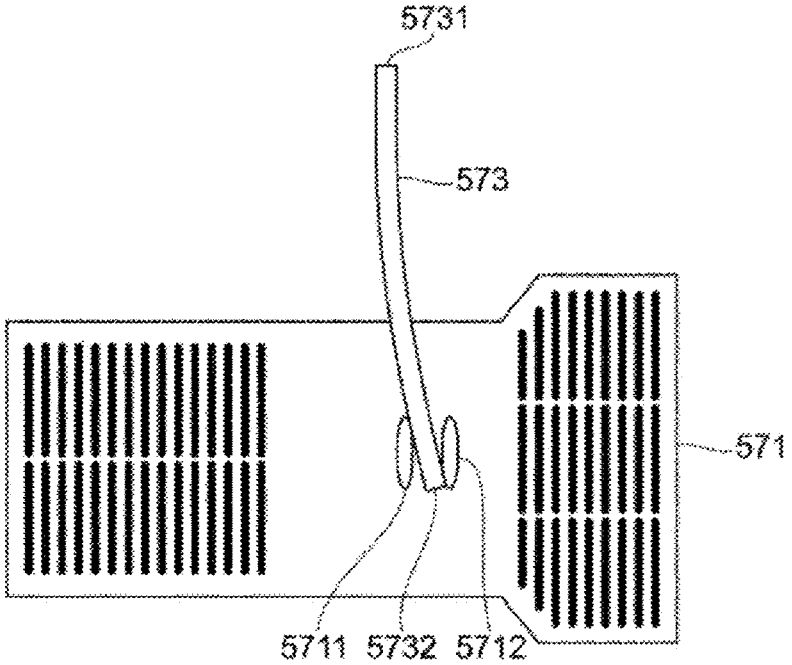
FIG. 15B illustrates a state of the bimetal plate when heat from the heater is transferred to the bimetal plate.

FIG. 15A illustrates a state of the bimetal plate 573 when heat from the heater 560 is not transferred to the bimetal plate 573, and FIG. 15B illustrates a state of the bimetal plate 573 when heat from the heater 560 is transferred to the bimetal plate 573. The arrangement of the bimetal plate 573 may be the same as an arrangement when the catalyst 550, the heater 560, and the metal component 565 are removed in FIG. 14A. A first end 5713 of the bimetal plate 573 may be fixed, whereas a second end 5732 of the bimetal plate 573 may be not fixed and contact the first protrusion 5711 and the second protrusion 5712 of the shutter 571.

When no heat from the heater 560 is transferred to the bimetal plate 573, the bimetal plate 573 may be aligned in a straight line. Accordingly, the bimetal plate 573 may not press the first protrusion 5711 and the second protrusion 5712, and the shutter 571 may move to a position of opening the inlet 591 and the outlet 592.

Meanwhile, when heat from the heater 560 is transferred, the bimetal plate 573 may press the first protrusion 5711 and the second protrusion 5712 since the second end 5732 is curved to the right, and the shutter 571 may move to a position of closing the inlet 591 and the outlet 592.

Figure 16:
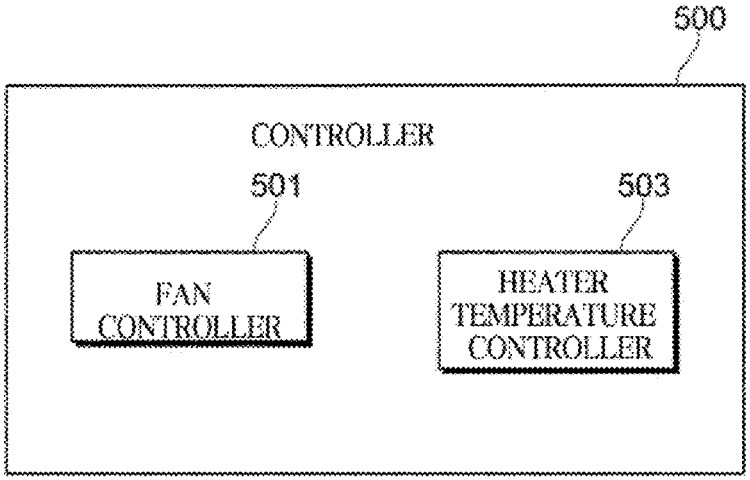
FIG. 16 illustrates a block diagram of a controller.

FIG. 16 illustrates a block diagram of the controller 500.

The controller 500 may include a fan controller 501 for controlling the rpm of a motor (not shown) for rotating the fan 510, and a heater temperature controller 503 for controlling a temperature of the heater 560.

The controller 500 may include at least one processor. The controller 500 may include a CPU (not shown) for arithmetic processing, ROM (not shown) for storing programs or various data that is executed by the CPU, and RAM (not shown) used as memory for tasks of the CPU. Also, the CPU may execute a program to implement the fan controller 501 and the heater temperature controller 503.

The fan controller 501 may convert the rpm of the fan 510 to two levels of high speed and low speed. However, the fan controller 501 may convert the rpm of the fan 510 to three or more levels or continuously. The fan controller 101 may convert the rpm of the fan 510 to high speed in the absorption mode, and in the regeneration mode, the fan controller 501 may convert the rpm of the fan 510 to low speed. That is, the fan controller 501 may be an example of a blow controller for controlling driving of the fan 510 in such a way to reduce an air volume when the heater 560 heats the catalyst 550 rather than when the heater 560 does not heat the catalyst 550.

When the fan controller 501 converts the rpm of the fan 510 to low speed (in the regeneration mode), the heater temperature controller 503 may supply electricity to the heater 560 for a predetermined time period, thereby raising the temperature of the heater 560 to a predetermined temperature. Meanwhile, when the fan controller 501 converts the rpm of the fan 510 to high speed (in the absorption mode), the heater temperature controller 503 may supply no electricity to the heater 560.

Figure 17A:
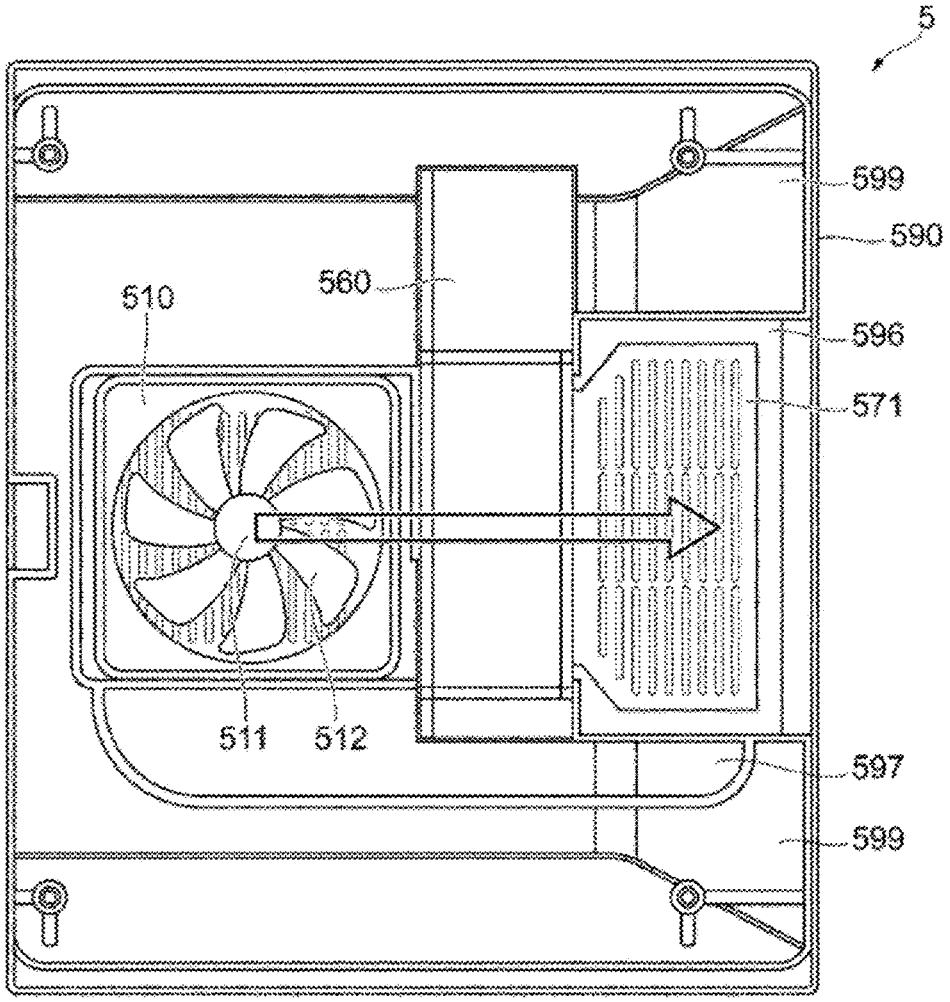
FIGS. 17A and 17B illustrate a flow of air when the deodorizing apparatus is in an absorption mode.
Figure 17B:
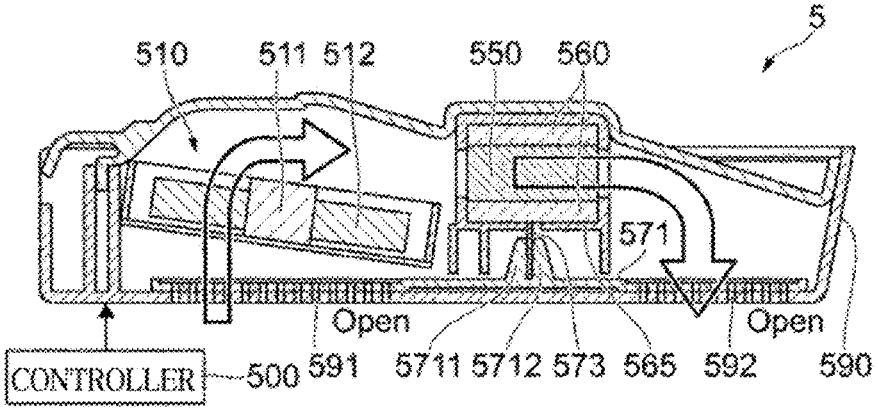

FIGS. 17A and 17B illustrate a flow of air when the deodorizing apparatus 5 is in the absorption mode.

Figure 18A:
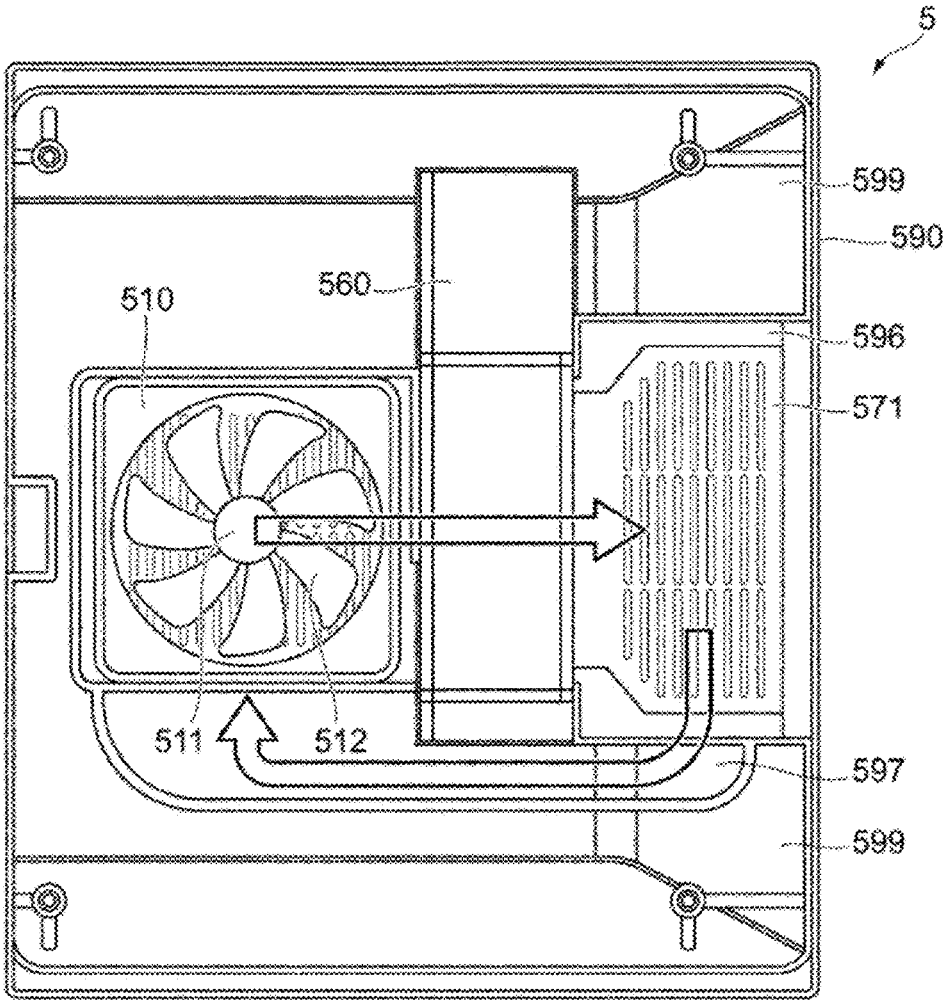
FIGS. 18A and 18B illustrate a flow of heat when the deodorizing apparatus is in a regeneration mode.
Figure 18B:
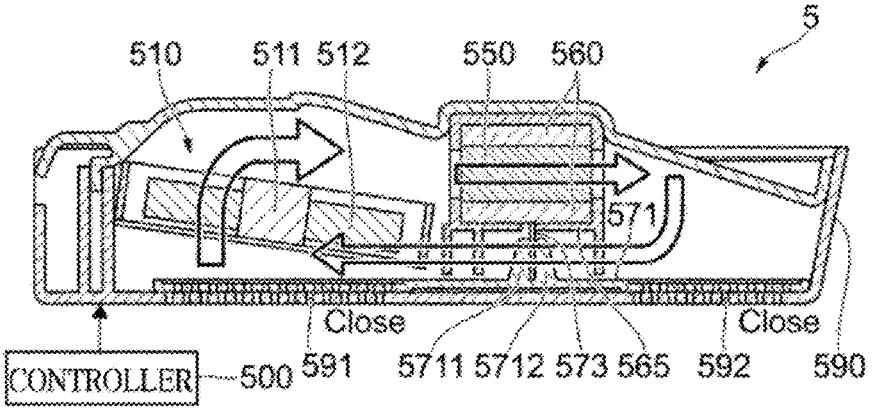

FIGS. 18A and 18B illustrate a flow of heat when the deodorizing apparatus 5 is in the regeneration mode.

When the deodorizing apparatus 5 according to an embodiment is in the absorption mode, the fan controller 501 may convert the rpm of the fan 510 to high speed, and the heater temperature controller 503 may supply no electricity to the heater 560 so as not to raise the temperature of the heater 560. At this time, air inhaled in the inside of the case 590 by the fan 510 may pass through the first accommodating room 596, and be discharged through the outlet 592. At this time, a malodorous substance included in the air may be absorbed in the catalyst 550.

Meanwhile, in the deodorizing apparatus 5, the fan controller 501 may convert the rpm of the fan 510 to low speed in the regeneration mode, and the heater temperature controller 503 may supply electricity to the heater 560 to raise the temperature of the heater 560, by taking into consideration that a decomposition rate of a malodorous substance of the catalyst 550 is slower than an absorption rate of the catalyst 550. At this time, air inhaled into the inside of the case 590 by the fan 510 may pass through the first accommodating room 596 to reach around the outlet 592. However, since the outlet 592 is closed by the shutter 571, the air may pass through the second accommodating room 597 to reach below the fan 510.

The catalyst 550 may get warm by the heater 560. Therefore, the catalyst 550 may be heated and activated to decompose a malodorous substance absorbed therein.

Meanwhile, in an embodiment, the heater 560 may be a contact type. That is, a configuration in which the heater 560 is in contact with the outer circumference of the catalyst 550 may be adopted.

However, the heater 560 may be a non-contact type. That is, a configuration in which the heater 560 is disposed downstream from the fan 510 and upstream from the catalyst 550 on a blowing path may be adopted. The configuration may heat air on the blowing path, and raise the temperature of the front surface of the catalyst 550 uniformly to an activation temperature.

Also, in an embodiment, when the deodorizing apparatus 5 is in the regeneration mode, the fan controller 501 may convert the rpm of the fan 510 to low speed, although not limited thereto. The fan controller 501 may rotate the fan 510 intermittently. In this case, the fan controller 501 may be an example of a blow controller for controlling driving of the fan 510 such that the fan 510 rotates intermittently when the heater 560 heats the catalyst 550. Also, in the case that the heater 560 is a contact type, the fan controller 501 may stop rotating the fan 510 when the deodorizing apparatus 5 is in the regeneration mode. In this case, the fan controller 501 may be an example of a blow controller for controlling driving of the fan 510 such that the fan 510 stops when the heater 560 heats the catalyst 550.

As described above, since the deodorizing apparatus 5 according to an embodiment regenerates the catalyst 550, the deodorizing apparatus 5 may maintain the absorption capability (deodorizing capability) of the catalyst 550 for a long time, compared with a case in which a catalyst is not regenerated. Also, by using the catalyst 550 for regeneration and exposing a malodorous substance absorbed in the catalyst 550 to the catalyst 550, it may be possible to increase decomposition speed. Also, by closing the opening/closing mechanism when raising the inside temperature of the case 590 to regenerate the catalyst 550, heat used for heating may be circulated. Also, since the case 590 is a double-layer structure having the air layer 599 in the inside, the inside of the case 590 may be insulated from the outside. Therefore, the deodorizing apparatus 5 may not discharge heat used for heating. As a result, the deodorizing apparatus 5 according to an embodiment may be used in an environment, such as the inside of the refrigerating room of a refrigerator, which needs to be maintained at a low temperature. Furthermore, although an odor is generated when a malodorous substance absorbed in the catalyst 550 is decomposed, the odor may be not discharged to the inside of the refrigerator since the opening/closing mechanism is closed.

Also, in an embodiment, the heater 560 may be any one of a non-contact type and a contact type. When a non-contact type, that is, the configuration in which the heater 560 is disposed downstream from the fan 510 and upstream from the catalyst 550 on the blowing path is adopted, heat may be applied to the front surface of the catalyst 550, and low-cost may be achieved. Meanwhile, when a contact type, that is, the configuration in which the heater 560 is in contact with the catalyst 550 is adopted, a simplified configuration may be implemented.

Meanwhile, in the deodorizing apparatus 5 described above, a timing of conversion between the absorption mode and the regeneration mode so that the absorption mode and the regeneration mode are performed alternately may be not limited to a specific timing. For example, the deodorizing apparatus 5 may convert the absorption mode to the regeneration mode after the absorption mode is performed for a predetermined absorption mode period, and then convert the regeneration mode to the absorption mode after the regeneration mode is performed for a predetermined regeneration mode period. The predetermined absorption mode period may be equal to or different from the predetermined regeneration mode period.

Also, the deodorizing apparatus 5 may include an odor sensor (not shown) for detecting an odor. For example, the odor sensor may be disposed downstream from the catalyst 550, and when an amount of odor detected by the odor sensor is equal to or more than a predetermined amount, the deodorizing apparatus 5 may convert the absorption mode to the regeneration mode. In this case, the deodorizing apparatus 5 may perform the regeneration mode for the predetermined regeneration mode period, and then convert the regeneration mode to the absorption mode.

A refrigerator to which the deodorizing apparatus 5 according to an embodiment is applied may be similar to the refrigerator to which the deodorizing apparatus 1 according to an embodiment as shown in FIGS. 5A and 5B is applied, and accordingly, further descriptions thereof will be omitted. However, in the deodorizing apparatus 1 according to an embodiment, the inlet 91 of the case 90 may be disposed in the front portion of the case 90, and the outlet 92 of the case 90 may be disposed in the rear portion of the case 90, whereas in the deodorizing apparatus 5 according to an embodiment, the lower surface of the case 590 may be toward the lower space of the refrigerator, and the inlet 591 may be disposed at the rear portion of the bottom of the case 590, and the outlet 592 may be disposed at the front portion of the bottom of the case 590.

According to the present disclosure, a deodorizing apparatus capable of being used in an environment that needs to be maintained at a low temperature and a refrigerator including the deodorizing apparatus may be provided.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a refrigerating room configured to refrigerate goods; and a deodorizing apparatus disposed in the refrigerating room and comprising:

a blower configured to generate a flow of air;

an absorptive decomposer disposed downstream from the blower and configured to absorb a malodorous substance from air passing therethrough and to decompose the malodorous substance by being heated;

a heater disposed downstream from the blower to heat the absorptive decomposer or disposed downstream from the blower and upstream from the absorptive decomposer to heat air to be entered the absorptive decomposer; and a suppressor configured to prevent air passed through the absorptive decomposer from being discharged to the outside of the deodorizing apparatus.

2. The refrigerator of claim 1, wherein:

the deodorizing apparatus further comprises a case configured to accommodate the blower, the heater, and the absorptive decomposer, the case comprising an inlet through which air enters and an outlet through which air exits, and the suppressor is configured to circulate air passed through the absorptive decomposer in the inside of the case in a state where the inlet and the outlet are closed.

3. The refrigerator of claim 2, wherein the deodorizing apparatus further comprises:

an opening/closing member configured to open or close the inlet and the outlet of the case in linkage with each other; and an opening/closing control member configured to control the opening/closing member to close the inlet and the outlet of the case when the heater heats the absorptive decomposer or air to be entered the absorptive decomposer.

4. The refrigerator of claim 3, wherein the opening/closing control member comprises a metal plate manufactured by coupling two kinds of metals together, the two kinds of metals comprising different thermal expansion rates.

5. The refrigerator of claim 3, wherein the deodorizing apparatus further comprises a member configured to transfer heat from the heater to the opening/closing control member.

6. The refrigerator of claim 1, wherein the heater is configured to heat the absorptive decomposer without making contact with the absorptive decomposer.

7. The refrigerator of claim 6, wherein:

the deodorizing apparatus further comprises a processor configured to control driving of the blower, and the processor is configured to control driving of the blower to reduce an air volume when the heater heats air.

8. The refrigerator of claim 1, wherein the heater is configured to heat the absorptive decomposer by contacting the absorptive decomposer.

9. The refrigerator of claim 8, wherein:

the deodorizing apparatus further comprises a processor configured to control driving of the blower, and the processor controls driving of the blower such that the blower stops when the heater heats air.

10. The refrigerator of claim 1, wherein the absorptive decomposer comprises:

an absorber disposed downstream from the blower and configured to absorb a malodorous substance from air passing therethrough and to desorb the malodorous substance by being heated; and a decomposer configured to decompose the malodorous substance desorbed from the absorber.

11. The refrigerator of claim 10, wherein the deodorizing apparatus further comprises a cooler configured to cool air passed through the decomposer.

12. The refrigerator of claim 11, wherein:

the deodorizing apparatus further comprises a processor configured to control driving of the blower, and the processor is configured to control driving of the blower to reduce an air volume when the heater heats air.

13. The refrigerator of claim 11, wherein the deodorizing apparatus further comprises:

a decomposing heater configured to heat the decomposer; and a cooling heat sink disposed downstream from the decomposer and configured to cool air passed through the decomposer.

14. The refrigerator of claim 13, wherein the deodorizing apparatus further comprises a heating heat sink disposed downstream from the blower and upstream from the absorber and configured to heat air sent by the blower.

15. The refrigerator of claim 14, wherein the cooler comprises a heat exchange device disposed between the cooling heat sink and the heating heat sink and is configured to absorb heat at the cooling heat sink and to radiate heat at the heating heat sink.

16. The refrigerator of claim 11, wherein:

the deodorizing apparatus further comprises a case configured to accommodate the absorber, the decomposer, and the cooler, the case comprises an inlet through which air enters and an outlet through which air exits, and a path of air from the inlet to the outlet is U shaped.

17. A deodorizing apparatus comprising:

a blower configured to generate a flow of air;

an absorptive decomposer disposed downstream from the blower and configured to absorb a malodorous substance from air passing therethrough and to decompose the malodorous substance by being heated;

a heater disposed downstream from the blower to heat the absorptive decomposer or disposed downstream from the blower and upstream from the absorptive decomposer to heat air to be entered the absorptive decomposer; and a suppressor configured to prevent air passed through the absorptive decomposer from being discharged to the outside of the deodorizing apparatus.

18. The deodorizing apparatus of claim 17, wherein the absorptive decomposer comprises:

an absorber disposed downstream from the blower and configured to absorb a malodorous substance from air passing therethrough and to desorb the malodorous substance by being heated; and a decomposer configured to decompose the malodorous substance desorbed from the absorber.

19. The deodorizing apparatus of claim 17, further comprises:

a case configured to accommodate the blower, the heater, and the absorptive decomposer, the case comprising an inlet through which air enters and an outlet through which air exits, and the suppressor is configured to circulate air passed through the absorptive decomposer in the inside of the case in a state where the inlet and the outlet are closed.

20. The deodorizing apparatus of claim 19, further comprises:

an opening/closing member configured to open or close the inlet and the outlet of the case in linkage with each other; and an opening/closing control member configured to control the opening/closing member to close the inlet and the outlet of the case when the heater heats the absorptive decomposer or air to be entered the absorptive decomposer.

* * * * *